US009999104B2

(12) United States Patent
Naruo et al.

(10) Patent No.: US 9,999,104 B2
(45) Date of Patent: Jun. 12, 2018

(54) LIGHTING DEVICE AND LUMINAIRE

(71) Applicant: Panasonic Intellectual Property Management Co., Ltd., Osaka (JP)

(72) Inventors: Masahiro Naruo, Osaka (JP); Kenichi Fukuda, Osaka (JP); Shinji Makimura, Nara (JP); Akira Nakajo, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days. days.

(21) Appl. No.: 15/047,446

(22) Filed: Feb. 18, 2016

(65) Prior Publication Data

US 2016/0270178 A1 Sep. 15, 2016

(30) Foreign Application Priority Data

Mar. 9, 2015 (JP) ..... 2015-045956

(51) Int. Cl.
*H05B 33/08* (2006.01)

(52) U.S. Cl.
CPC ..... *H05B 33/0815* (2013.01); *H05B 33/0827* (2013.01); *H05B 33/0866* (2013.01)

(58) Field of Classification Search
CPC ..... H05B 33/083; H05B 33/0839; H05B 33/0848; H05B 33/0866; H05B 33/0884; H05B 37/02; H05B 33/0815; H05B 33/0824; H05B 33/0827; H05B 33/042; H05B 37/029; H05B 37/032; H05B 37/036; H05B 33/0857
See application file for complete search history.

(56) References Cited

U.S. PATENT DOCUMENTS 8,585,212 B2 11/2013 Huber et al.
8,773,087 B2 7/2014 Otte et al.
(Continued)

FOREIGN PATENT DOCUMENTS

JP 2007-220855 A 8/2007
JP 2008-210607 A 9/2008
(Continued)

*Primary Examiner* — Douglas W Owens
*Assistant Examiner* — Henry Luong
(74) *Attorney, Agent, or Firm* — Renner, Otto, Boisselle & Sklar, LLP

(57) ABSTRACT

A lighting device that supplies current to light-emitting units includes: a DC-to-DC converter; a switch unit connected to the light-emitting units; and a control circuit which controls the DC-to-DC converter and the switch unit. The DC-to-DC converter includes: an inductor through which current from the DC-to-DC converter is provided to the light-emitting units; and a first switch element connected in series with the inductor and which switches ON/OFF. The control circuit includes: a zero-crossing detector that detects that current flowing in the inductor is substantially zero due to the first switch element switching OFF, and outputs a zero-current detection signal; and a switch controller that selects one of the light-emitting units and controls the switch unit to cause the current from the DC-to-DC converter to be supplied to the selected light-emitting unit when the first switch element subsequently switches ON, each time the switch controller receives the zero-current detection signal.

14 Claims, 13 Drawing Sheets

(56) References Cited

U.S. PATENT DOCUMENTS

| | | | | |
|---|---|---|---|---|
| 8,890,429 | B2 | 11/2014 | Fukuda et al. | |
| 2008/0116818 | A1* | 5/2008 | Shteynberg | H05B 33/0815 315/192 |
| 2009/0128045 | A1* | 5/2009 | Szczeszynski | H05B 33/0815 315/185 R |
| 2009/0231552 | A1 | 9/2009 | Huber et al. | |
| 2010/0253302 | A1 | 10/2010 | Otte et al. | |
| 2012/0098442 | A1 | 4/2012 | Jin | |
| 2013/0285563 | A1 | 10/2013 | Iwai et al. | |
| 2014/0077719 | A1 | 3/2014 | Fukuda et al. | |
| 2014/0210367 | A1* | 7/2014 | Zijlman | H05B 33/083 315/188 |
| 2014/0252967 | A1* | 9/2014 | van de Ven | H05B 33/083 315/188 |
| 2014/0354156 | A1* | 12/2014 | Yang | H05B 33/083 315/122 |
| 2015/0173143 | A1* | 6/2015 | Zhang | H05B 33/0827 315/185 R |

FOREIGN PATENT DOCUMENTS

| | | | |
|---|---|---|---|
| JP | 2009-089115 | A | 4/2009 |
| JP | 2009-537939 | A | 10/2009 |
| JP | 2011-504075 | A | 1/2011 |
| JP | 2011-242619 | A | 12/2011 |
| JP | 2013-229234 | A | 11/2013 |
| JP | 2014-056803 | A | 3/2014 |
| WO | WO 2009/060400 | A1 | 5/2009 |

* cited by examiner

LIGHTING DEVICE AND LUMINAIRE

CROSS REFERENCE TO RELATED APPLICATION

This application claims the benefit of priority of Japanese Patent Application Number 2015-045956 filed on Mar. 9, 2015, the entire content of which is hereby incorporated by reference.

BACKGROUND

1. Technical Field

The present disclosure relates to a lighting device that supplies a solid-state light-emitting element such as a light emitting diode (LED) or an organic electro luminescence (EL) element with current, and to a luminaire including the lighting device.

2. Description of the Related Art

Conventionally, luminaires in which toning is controlled by simultaneously turning ON LEDs which have plural light colors (i.e., colors of light) have been proposed. These luminaires typically include plural DC-to-DC converters as well as lighting switches and constant current circuits which correspond to the respective LEDs which have different light colors. In these luminaires, one constant current circuit is provided to the LEDs of each light color, and thus the circuit board including the constant current circuits becomes big. Furthermore, these luminaires have a large number of parts, and thus also have a disadvantage in terms of cost. In view of this, an LED drive circuit that can remedy the aforementioned problems has been proposed (see Patent Literature (PTL) 1: Japanese Unexamined Patent Application Publication No. 2009-89115).

SUMMARY

In the LED drive circuit disclosed in PTL 1, the output current from a single DC-to-DC converter is sequentially supplied to plural LEDs by a load-switching switch unit. With this, the LED drive circuit attempts to remedy the aforementioned problems.

However, in this LED drive circuit, when the load voltages (that is, the forward voltages) of the respective LEDs are different, a surge current caused by the difference in load voltages is generated during the switching operation of the load-switching switch unit. Although PTL 1 discloses a technique of absorbing the surge current using a capacitor, it is not possible to avoid the occurrence of switching loss in the load-switching switch unit. Furthermore, in the LED drive circuit, the occurrence of a load voltage overshoot immediately after the switching operation of the load-switching switch unit causes LED current to increase. This causes unevenness in the ratio of current supplied to the LEDs of each light color. In other words, in a luminaire including the above-described LED drive circuit, color reproducibility of illumination light is low. Furthermore, although it is also possible to partially control the overshoot, this requires a large-capacity capacitor.

The present disclosure is conceived in order to solve such problems and has as an object to provide (i) a lighting device which sequentially supplies current to each of light-emitting units respectively including a solid-state light emitting element, and is compact, highly-efficient, and capable of suppressing unevenness in the ratio of current supplied to each of the light-emitting units, and (ii) a luminaire including the lighting device.

In order to achieve the above object, a lighting device according to an aspect of the present disclosure is a lighting device that supplies current to a plurality of light-emitting units each including a solid-state light-emitting element, the lighting device including: a DC-to-DC converter; a switch unit connected to the plurality of light-emitting units; and a control circuit which controls the DC-to-DC converter and the switch unit. The DC-to-DC converter includes: an inductor through which current from the DC-to-DC converter is provided to the plurality of light-emitting units; and a first switch element connected in series with the inductor and which switches between an ON state and an OFF state. The control circuit includes: a zero-crossing detector that detects that current flowing in the inductor has become substantially zero as a result of the first switch element switching to the OFF state, and outputs a zero current detection signal; and a switch controller that selects a single light-emitting unit from among the plurality of light-emitting units and controls the switch unit to cause the current from the DC-to-DC converter to be supplied to the single light-emitting unit when the first switch element subsequently switches to the ON state, each time the switch controller receives the zero current detection signal from the zero-crossing detector.

The present disclosure can provide (i) a lighting device which sequentially supplies current to each of light-emitting units respectively including a solid-state light emitting element, and is compact, highly-efficient, and capable of suppressing unevenness in the ratio of current supplied to each of the light-emitting units, and (ii) a luminaire including the lighting device.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

Hereinafter, exemplary embodiments of the present disclosure will be described with reference to the drawings. It should be noted that each of the subsequently-described embodiments show a specific example of the present disclosure. Therefore, numerical values, shapes, materials, structural components, the arrangement and connection of the structural components, steps, and the sequence of the steps, etc. shown in the following embodiments are mere examples, and are not intended to limit the scope of the present disclosure. Furthermore, among the structural components in the following embodiments, components not recited in any one of the independent claims which indicate the broadest concepts of the present disclosure are described as arbitrary structural components.

It should be noted that the respective figures are schematic diagrams and are not necessarily precise illustrations. Furthermore, in the respective figures, substantially identical components are assigned the same reference signs, and overlapping description is omitted or simplified.

Embodiment 1

[1-1. Configuration]

First, a configuration of a lighting device and a luminaire according to Embodiment 1 will be described with reference to the drawings.

Figure 1:
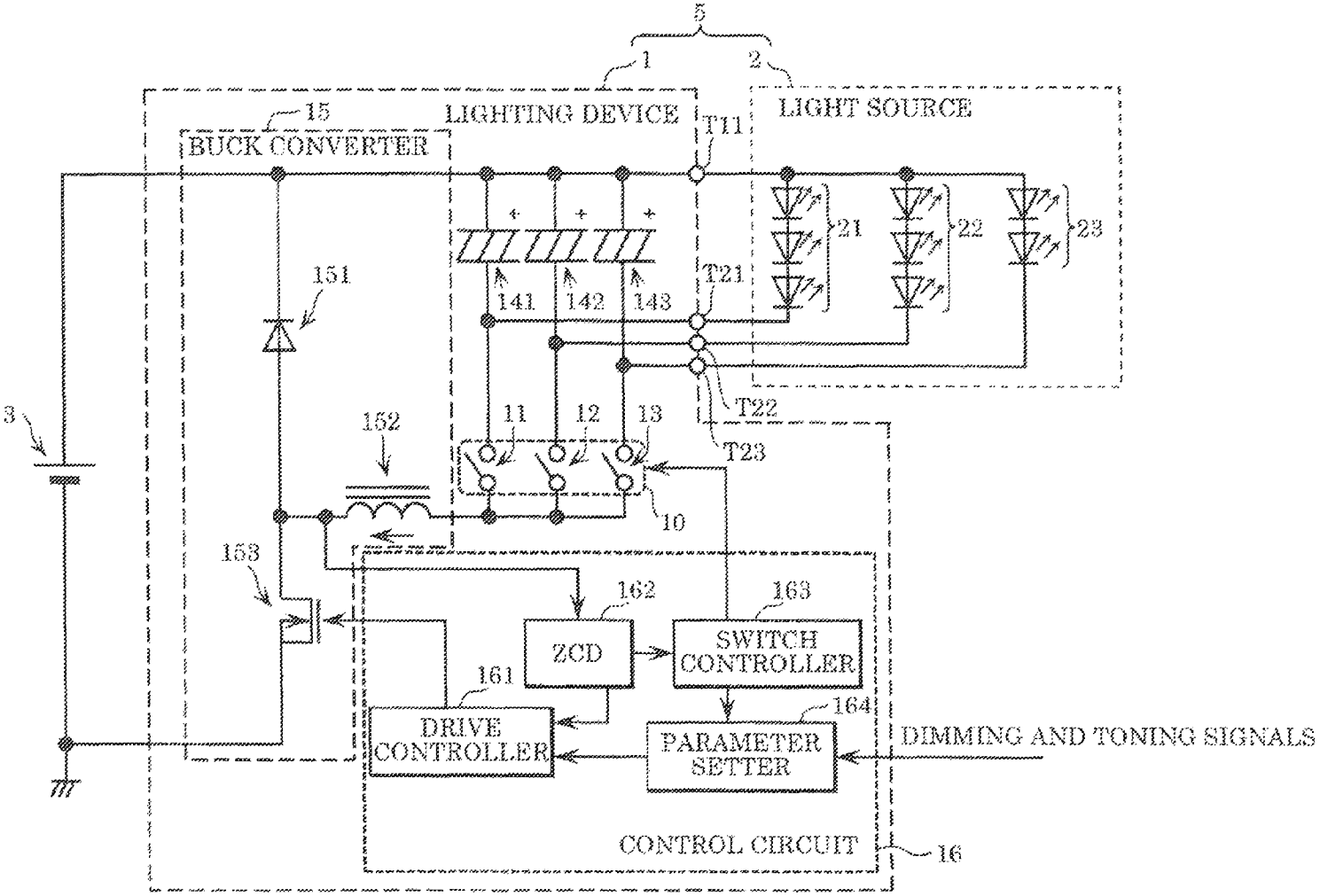
FIG. 1 is a circuit diagram illustrating a configuration of a lighting device and a luminaire including the lighting device according to Embodiment 1.

FIG. 1 is a circuit diagram illustrating the configuration of lighting device 1 and luminaire 5 including lighting device 1 according to this embodiment. FIG. 1 also illustrates direct current (DC) power supply 3 together with lighting device 1 and luminaire 5.

As illustrated in FIG. 1, luminaire 5 includes lighting device 1 and light source 2.

Light source 2 includes plural light-emitting units 21, 22, and 23, each of which is a solid-state light-emitting element.

In this embodiment, each of light-emitting units 21, 22, and 23 includes a single LED or plural LEDs. Furthermore, the color of light (hereafter also referred to as light color) of each of light-emitting units 21, 22, and 23 is different. For example, the light colors of light-emitting units 21, 22, and 23 are blue, green, and red, respectively. It should be noted that each light color may be realized by the color of light emitted by the LED itself or by transforming the light emitted by the LED, using phosphors, optical filters, etc. Furthermore, the forward voltages of light-emitting units 21, 22, and 23 may be different. In this embodiment, the respective forward voltages of light-emitting units 21, 22, and 23 decrease in the order of light-emitting unit 21, 22, and 23. In other words, the forward voltage of light-emitting unit 21 is highest and the forward voltage of light-emitting unit 23 is lowest. It should be noted that, here, in the case where plural LEDs are connected in series, the forward voltage of each light-emitting unit means the sum of the respective forward voltages of the plural LEDs included in the light-emitting unit.

Lighting device 1 is a device that supplies current to plural light-emitting units 21, 22, and 23. In this embodiment, lighting device 1 is supplied with direct current voltage Vdc from DC power supply 3. As illustrated in FIG. 1, lighting device 1 includes switch unit 10, buck converter 15, control circuit 16, and smoothing capacitors 141, 142, and 143. Furthermore, lighting device 1 includes output terminals T11, T21, T22, and T23 for supplying current to light source 2.

Buck converter 15 is a DC-to-DC converter that converts the output voltage Vdc of DC power supply 3 and outputs the resulting voltage. As illustrated in FIG. 1, buck converter 15 includes rectifier element 151, inductor 152, and first switch element 153. Furthermore, first switch element 153 has one end (drain electrode) connected in series with inductor 152 and the other end (source electrode) connected to the low potential-side (earth-side) output terminal of DC power supply 3. Furthermore, rectifier element 151 has a cathode connected to the high potential-side output terminal of DC power supply 3, and an anode connected to the connection point between inductor 152 and first switch element 153.

Rectifier element 151 is an element that forms a closed circuit together with inductor 152 and the load connected to the output terminal of buck converter 15, and regenerates the energy stored in inductor 152. Rectifier element 151 is configured of a diode, for example.

Inductor 152 is a choke coil, and stores and releases energy depending on the switching of first switch element 153.

First switch element 153 is an element that performs switching (i.e., repeats switching to ON and OFF states) under the control of drive controller 161 of control circuit 16, and, in this embodiment, is an N-channel metal-oxide semiconductor field-effect transistor (MOSFET) connected in series with inductor 152.

Switch unit 10 is a circuit which selects, from among light-emitting units 21, 22, and 23, any one light-emitting unit to be supplied with current from buck converter 15. As illustrated in FIG. 1, switch unit 10 includes second switch elements 11, 12, and 13. Second switch elements 11, 12, and 13 are connected in series with light-emitting units 21, 22, and 23, respectively. In order to supply current from buck converter 15 to any one of light-emitting units 21, 22, and 23, the second switch element connected in series with the light-emitting unit to be supplied with the current is controlled to switch to the ON state, and the other second switch elements are controlled to switch to the OFF state. In this embodiment, second switch elements 11, 12, and 13 are configured of elements that can be controlled individually to switch to the ON and OFF states according to signals from switch controller 163. Second switch elements 11, 12, and 13 are configured of MOSFETs, etc., for example.

Smoothing capacitors 141, 142, and 143 are elements for smoothing ripple voltage outputted from buck converter 15. Smoothing capacitors 141, 142, and 143 are connected in series with second switch elements 11, 12, and 13, respectively. Furthermore, light-emitting units 21, 22, and 23 are connected in parallel to both ends of smoothing capacitors 141, 142, and 143, respectively. In this embodiment, smoothing capacitors 141, 142, and 143 are configured of electrolytic capacitors.

Control circuit 16 is a circuit that controls buck converter 15 and switch unit 10, based on inputted dimming and toning signals. As illustrated in FIG. 1, control circuit 16 includes drive controller 161, zero-crossing detector circuit (ZCD) 162, switch controller 163, and parameter setter 164.

Parameter setter 164 is a processing unit which sets a parameter corresponding to the current to be supplied to each of light-emitting units 21, 22, and 23. In this embodiment, parameter setter 164 receives the dimming and toning signals and, from switch controller 163, a signal corresponding to the second switch element to be switched to the ON state, that is, a signal corresponding to the light-emitting unit to be supplied with current, and sets a parameter corresponding to the current to be supplied to the light-emitting unit. Furthermore, parameter setter 164 outputs a signal corresponding to the parameter to drive controller 161. In this embodiment, the parameter is the ON time of first switch element 153. The longer the ON time of first switch element 153 is, the larger the current to be supplied to the respective light-emitting units becomes. For example, in order to cause light source 2 to emit illumination light with a high dimming level (i.e., low output illumination light), parameter setter 164 sets a short ON time so that the current supplied to each of the light-emitting units becomes smaller. Furthermore, for example, in order to cause light source 2 to emit illumination light having a blue light color, parameter setter 164 sets the ON time when supplying current to each of the light-emitting units such that the current supplied to light-emitting unit 21 becomes larger and the current supplied to light-emitting units 22 and 23 becomes smaller. More specifically, parameter setter 164 sets ON times $Ton_1$, $Ton_2$, and $Ton_3$ of first switch element 153 in the case where each of second switching elements 11, 12, and 13 is to be kept in the ON state. Here, parameter setter 164 sets the respective ON times so that $Ton_1$ becomes longer than $Ton_2$ and $Ton_3$. Parameter setter 164 includes a processor with a built-in lookup table, for example. The lookup table stores information regarding dimming and toning signals and ON times $Ton_1$, $Ton_2$, and $Ton_3$ of first switch element 153 corresponding to the dimming and toning signals. With this, the processor included in parameter setter 164 can output, to drive controller 161, signals corresponding to the ON times $Ton_1$, $Ton_2$, and $Ton_3$ of first switch element 153, based on the inputted dimming and toning signals.

ZCD 162 is a circuit that detects that the current flowing in inductor 152 has become zero, and outputs a zero-crossing detection signal. It should be noted that, here, the current flowing in inductor 152 is zero means that the current flowing in inductor 152 is substantially zero, and is not limited to when the current flowing in inductor 152 is exactly zero. For example, it is sufficient that the current flowing in inductor 152 is within the range of measurement error from zero of ZCD 162. ZCD 162 outputs the zero-crossing detection signal to drive controller 161 and switch controller 163. In this embodiment, ZCD 162 detects the current flowing in inductor 152 by detecting the potential at the connection point between inductor 152 and rectifier element 151.

Drive controller 161 is a controller that controls first switch element 153 based on the parameter set by parameter setter 164. In this embodiment, when drive controller 161 receives a zero-crossing detection signal from ZCD 162, drive controller 161 outputs an H-level (high level) signal to the gate electrode of first switch element 153 to cause first switch element 153 to switch to the ON state. Furthermore, drive controller 161 keeps first switch element 153 in the ON state throughout an ON time which is set based on the signal inputted from parameter setter 164. Furthermore, when the ON time has elapsed, drive controller 161 outputs an L-level (low level) signal to the gate electrode of first switch element 153 to cause first switch element 153 to switch to the OFF state.

Switch controller 163 is a controller that selects one light-emitting unit from among light-emitting units 21, 22, and 23 and causes switch unit 10 to supply current from buck converter 15 to the light-emitting unit, each time switch controller 163 receives a zero-crossing detection signal from ZCD 162. Switch controller 163 selects one light-emitting unit from among the plural light-emitting units based on a predetermined order. In this embodiment, the predetermined order is an order which goes around in a descending order starting from light-emitting unit 21 which has the highest forward voltage among plural light-emitting units 21, 22, and 23. Furthermore, switch controller 163 is a sequential circuit that outputs signals to second switch elements 11, 12, and 13 of switch unit 10 repeatedly in sequence to repeatedly supply current in the order of light-emitting unit 21, then light-emitting unit 22, then light-emitting unit 23, for example. Furthermore, switch controller 163 also outputs signals corresponding to the aforementioned signals to parameter setter 164 to convey to parameter setter 164 which of the light-emitting units is to be supplied with current.

Output terminal T11 is an output terminal on the high potential-side of lighting device 1. The anode-side terminals of light-emitting units 21, 22, and 23 of light source 2 are connected to output terminal T11.

Output terminals T21, T22, and T23 are output terminals on the low potential-side of lighting device 1. Output terminal T21 is connected to the connection point between smoothing capacitor 141 and second switch element 11; output terminal T22 is connected to the connection point between smoothing capacitor 142 and second switch element 12; and output terminal T23 is connected to the connection point between smoothing capacitor 143 and second switch element 13. Furthermore, the cathode-side terminals of light-emitting units 21, 22, and 23 of light source 2 are connected to output terminals T21, T22, and T23, respectively.

[1-2. Operation]

Next, operation of lighting device 1 according to this embodiment will be described with reference to the drawings.

Figure 2:
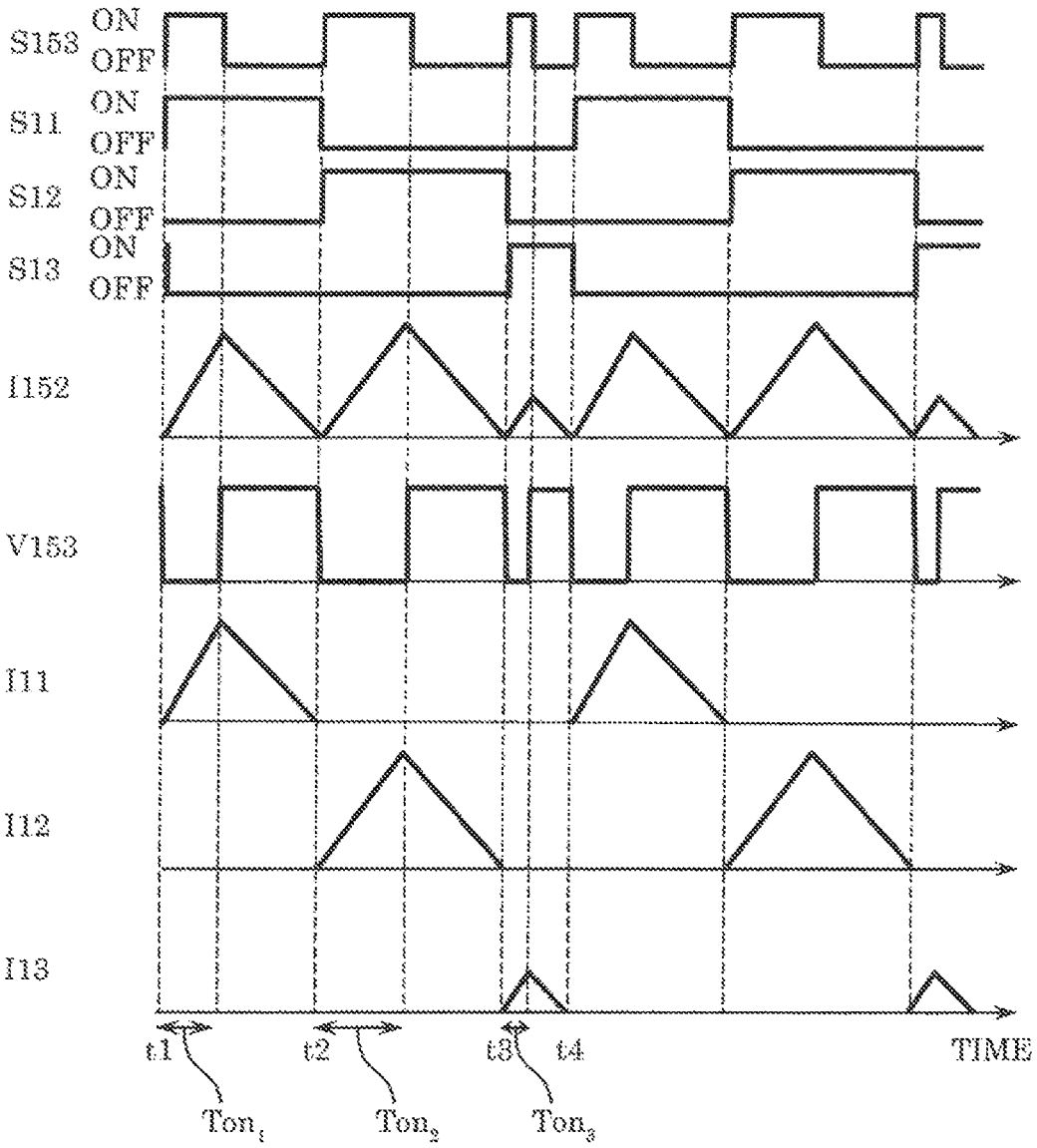
FIG. 2 is a timing chart illustrating an example of an operation of the lighting device according to Embodiment 1.

FIG. 2 is a timing chart illustrating an example of the operation of lighting device 1 according to this embodiment. FIG. 2 illustrates outlines of time waveforms of state S153 of first switch element 153, respective states S11, S12, and S13 of second switch elements 11, 12, and 13, and current I152 flowing in inductor 152. Furthermore, FIG. 2 illustrates an outline of time waveforms of voltage V153 applied to both ends of first switch element 153, and currents I11, I12, and I13 flowing in second switch elements 11, 12, and 13, respectively.

As illustrated in FIG. 2, first, at time t1, when drive controller 161 causes first switch element 153 to switch to the ON state, current flows to the circuit configured from DC power supply 3, light source 2, switch unit 10, inductor 152, and first switch element 153. This causes current I152 flowing in inductor 152 to gradually increase. Here, when second switching element 11 is kept in the ON state and second switching elements 12 and 13 are kept in the OFF state by switch controller 163, current I11 flowing in second switch element 11 gradually increases.

When the time for which first switch element 153 is kept in the ON state passes ON time $Ton_1$, which is set based on a signal inputted from parameter setter 164, drive controller 161 causes first switch element 153 to switch to the OFF state. In this case, the energy stored in inductor 152 causes current to flow in the closed circuit configured from inductor 152, rectifier element 151, light-emitting unit 21, and second switch element 11. The current that flows in this closed circuit decreases with the decrease in the energy stored in inductor 152. This causes current I152 flowing in inductor 152 and current I11 flowing in second switch element 11 to gradually decrease and become approximately zero. Here, when ZCD 162 detects that current I152 flowing in inductor 152 is approximately zero (time t2), ZCD 162 outputs a zero-crossing detection signal to drive controller 161 and switch controller 163.

When switch controller 163 receives the zero-crossing detection signal at time t2, switch controller 163 outputs, to switch unit 10, signals for causing second switch element 11 to switch to the OFF state and second switch element 12 to switch to the ON state. It should be noted that second switch element 13 is still kept in the OFF state. Furthermore, switch controller 163 also outputs to parameter setter 164 signals corresponding to the signals outputted to switch unit 10. Based on these signals, parameter setter 164 detects second switch element 12 which is to be switched to the ON state and light-emitting unit 22 corresponding to second switch element 12, and outputs to drive controller 161 a signal corresponding to the current to be supplied to light-emitting unit 22. In this embodiment, parameter setter 164 outputs to drive controller 161 a signal corresponding to ON time $Ton_2$.

When drive controller 161 receives the zero-crossing detection signal from ZCD 162 at time t2, drive controller 161 causes first switch element 153 to switch to the ON state. This causes current I152 flowing in inductor 152 and current I12 flowing in second switch element 12 to gradually increase.

When the time for which first switch element 153 is kept in the ON state passes ON time $Ton_2$, which is set based on a signal inputted from parameter setter 164, drive controller 161 causes first switch element 153 to switch to the OFF state. In this case, the energy stored in inductor 152 causes current to flow in the closed circuit configured from inductor 152, rectifier element 151, light-emitting unit 22, and second switch element 12. The current that flows in this closed circuit decreases with the decrease in the energy stored in inductor 152. This causes current I152 flowing in inductor 152 and current I12 flowing in second switch element 12 to gradually decrease and become approximately zero. Here, when ZCD 162 detects that current I152 flowing in inductor 152 is approximately zero (time t3), ZCD 162 outputs a zero-crossing detection signal to drive controller 161 and switch controller 163.

When switch controller 163 receives the zero-crossing detection signal at time t3, switch controller 163 outputs, to switch unit 10, signals for causing second switch element 12 to switch to the OFF state and second switch element 13 to switch to the ON state. It should be noted that second switch element 11 is still kept in the OFF state. Furthermore, switch controller 163 also outputs to parameter setter 164 signals corresponding to the signals outputted to switch unit 10. Based on these signals, parameter setter 164 detects second switch element 13 which is to be switched to the ON state and light-emitting unit 23 corresponding to second switch element 13, and outputs to drive controller 161 a signal corresponding to the current supplied to light-emitting unit 23. In this embodiment, parameter setter 164 outputs to drive controller 161 a signal corresponding to ON time $Ton_3$.

When drive controller 161 receives the zero-crossing detection signal from ZCD 162 at time t3, drive controller 161 causes first switch element 153 to switch to the ON state. This causes current I152 flowing in inductor 152 and current I13 flowing in second switch element 13 to gradually increase.

When the time for which first switch element 153 is kept in the ON state passes ON time $Ton_3$, which is set based on a signal inputted from parameter setter 164, drive controller 161 causes first switch element 153 to switch to the OFF state. In this case, the energy stored in inductor 152 causes current to flow in the closed circuit configured from inductor 152, rectifier element 151, light-emitting unit 23, and second switch element 13. The current that flows in this closed circuit decreases with the decrease in the energy stored in inductor 152. This causes current I152 flowing in inductor 152 and current I13 flowing in second switch element 13 to gradually decrease and become approximately zero. Here, when ZCD 162 detects that current I152 flowing in inductor 152 is approximately zero (time t4), ZCD 162 outputs a zero-crossing detection signal to drive controller 161 and switch controller 163.

When switch controller 163 receives the zero-crossing detection signal at time t4, switch controller 163 outputs, to switch unit 10, signals for causing second switch element 13 to switch to the OFF state and second switch element 11 to switch to the ON state. It should be noted that second switch element 12 is still kept in the OFF state. Furthermore, switch controller 163 also outputs to parameter setter 164 signals corresponding to the signals outputted to switch unit 10. Based on these signals, parameter setter 164 detects second switch element 11 which is to be switched to the ON state and light-emitting unit 21 corresponding to second switch element 11, and outputs to drive controller 161 a signal corresponding to the current supplied to light-emitting unit 21. In this embodiment, parameter setter 164 outputs to drive controller 161 a signal corresponding to ON time $Ton_1$.

From hereon, lighting device 1 is able to output currents for realizing the dimming level and the toning corresponding to dimming and toning signals, by repeating the same operation.

It should be noted that since currents I11, I12, and I13 illustrated in FIG. 2 are smoothed by smoothing capacitors 141, 142, and 143, the approximate average current of currents I11, I12, and I13 having triangular waves is supplied to light-emitting units 21, 22, and 23, respectively.

Here, the current supplied to the respective light-emitting units from lighting device 1 according to this embodiment is reviewed.

In this embodiment, the period in which current is supplied to light-emitting unit 2*n* (where n is 1, 2, or 3) can be represented as $Vdc \cdot Ton_n / VI_n$. Here, Vdc denotes the output voltage of DC power supply 3; $VL_n$ denotes the forward voltage of light-emitting unit 2*n*; and $Ton_n$ denotes the ON time of first switch element 153 when current is to be supplied to light-emitting unit 2*n*. Therefore, the cycle in which current is supplied from lighting device 1 to light-emitting units 21, 22, and 23 can be represented by Expression 1 below.

[Math. 1]

$$Vdc \sum_i \frac{Ton_i}{VL_i} \quad \text{(Expression 1)}$$

Furthermore, average current $IL_n$ in the period in which current is supplied to light-emitting unit 2*n* can be represented by Expression 2 below.

[Math. 2]

$$IL_n = \frac{1}{2} \frac{Vdc - VL_n}{L1} Ton_n \cdot \frac{Vdc}{VL_n} Ton_n / Vdc \sum_i \frac{Ton_i}{VL_i} \quad \text{(Expression 2)}$$

$$= \frac{1}{2} \frac{Vdc - VL_n}{VL_n} \cdot \frac{Ton_n^2}{L1} \Big/ \sum_i \frac{Ton_i}{VL_i}$$

Here, L1 denotes the inductance of inductor 152.

Therefore, the average current flowing in light-emitting unit 2*n* is proportional to the value represented by Expression 3 below.

[Math. 3]

$$\frac{Vdc - VL_n}{VL_n} Ton_n^2 \quad \text{(Expression 3)}$$

Therefore, average current $IL_n$ flowing in light-emitting unit 2*n* is generally proportional to the square of $Ton_n$.

Furthermore, in this embodiment, the switching cycle of first switch element 153 is, for example, on the order of several microseconds to tens of microseconds, and thus the light colors of the light emitted from the respective light-emitting units look blended together. Accordingly, luminaire 5 using lighting device 1 makes toning possible.

It should be noted that although, in the above-described operation, the setting of the ON time by parameter setter 164 is performed at the timing at which the zero-crossing detection signal is outputted, the timing for setting the ON time is not limited to such. For example, the ON time may be fixed in a period in which first switch element 153 is in the OFF state (i.e., an OFF period).

[1-3. Advantageous Effect, Etc.]

As described above, lighting device 1 according to this embodiment includes: buck converter 15; switch unit 10 connected to plural light-emitting units; and control circuit 16. Here, buck converter 15 includes: inductor 152 through which current from buck converter 15 is provided to the plural light-emitting units, and first switch element 153 connected in series with inductor 152 and which switches between an ON state and an OFF state. Furthermore, control circuit 16 includes: ZCD 162 which detects that the current flowing in inductor 152 has become zero as a result of first switch element 153 switching to the OFF state, and outputs a zero-crossing detection signal; and switch controller 163 which selects one light-emitting unit from among the plural light emitting units and causes switch unit 10 to supply current from buck converter 15 to the light-emitting unit when first switch element 153 subsequently switches to the ON state, each time switching controller 163 receives a zero-crossing detection signal from ZCD 162.

Accordingly, since lighting device 1 does not require a buck converter to be provided to each of the plural light-emitting units, lighting device 1 can be miniaturized. Furthermore, according to lighting device 1, when supplying current to plural light-emitting units, the current is supplied to the respective light-emitting units from a single buck converter, thereby suppressing unevenness in the ratio of current supplied to each of the light-emitting units. Therefore, when toning is performed by causing the respective light-emitting units to emit lights of different light colors, a mixed light having the desired light color can be obtained. Furthermore, in lighting device 1, the light-emitting unit to be supplied with current is switched when zero current is detected, and thus switching loss and noise can be suppressed.

Furthermore, in lighting device 1, switch unit 10 may include plural second switching elements connected in series with plural light-emitting units, respectively; and switch controller 163 may include a sequential circuit which controls the switching to ON and OFF states of the plural second switch elements.

Furthermore, lighting device 1 further includes parameter setter 164 which sets a parameter corresponding to the current supplied to each of the light-emitting units.

Accordingly, in lighting device 1, the current supplied to each of the light-emitting units can be arbitrarily adjusted according to a desired dimming level, etc.

Furthermore, in lighting device 1, parameter setter 164 sets the ON time of first switch element 153 as the parameter.

Accordingly, in lighting device 1, the current to be supplied to each of the light-emitting units is adjusted according to the ON time of first switch element 153, and thus a configuration for detecting the peak value of current is not required. Therefore, the structural components of lighting device 1 can be reduced.

Furthermore, in lighting device 1, switch controller 163 selects one of the light-emitting units based on a predetermined order, and this order is an order which goes around in a descending order from the light-emitting unit having the highest forward voltage.

Accordingly, it is possible to suppress to a minimum the amount of decrease in forward voltage when switching unit 10 switches the light-emitting unit to be supplied with current. Therefore, since the surge current generated in lighting device 1 is suppressed, current loss which accompanies the switching between light-emitting units is also suppressed. In other words, a highly efficient lighting device 1 can be realized.

Furthermore, luminaire 5 according to this embodiment includes lighting device 1 and the plural light-emitting units.

Accordingly, luminaire 5 is capable of producing the same advantageous effects as lighting device 1.

Furthermore, in luminaire 5, the light color of at least one of the plural light-emitting units is different from the light color of the remainder of the light-emitting units.

Accordingly, toning of lights emitted from luminaire 5 can be performed by adjusting the current supplied to each of the light-emitting units.

Embodiment 2

Next, a lighting device and a luminaire according to Embodiment 2 will be described. The lighting device and luminaire according to this embodiment are different from lighting device 1 and luminaire 5 according to Embodiment 1 in that the first switch element in the buck converter is controlled to switch to the OFF state when it is detected that the current flowing in the first switch element exceeds a predetermined threshold value.

Hereinafter, the lighting device and the luminaire according to this embodiment will be described focusing on structural components that are different from those in lighting device 1 and luminaire 5 according to Embodiment 1, and description of common structural components will be omitted for the sake of brevity.

[2-1. Configuration]

First, a configuration of the lighting device and the luminaire according to this embodiment will be described with reference to the drawings.

Figure 3:
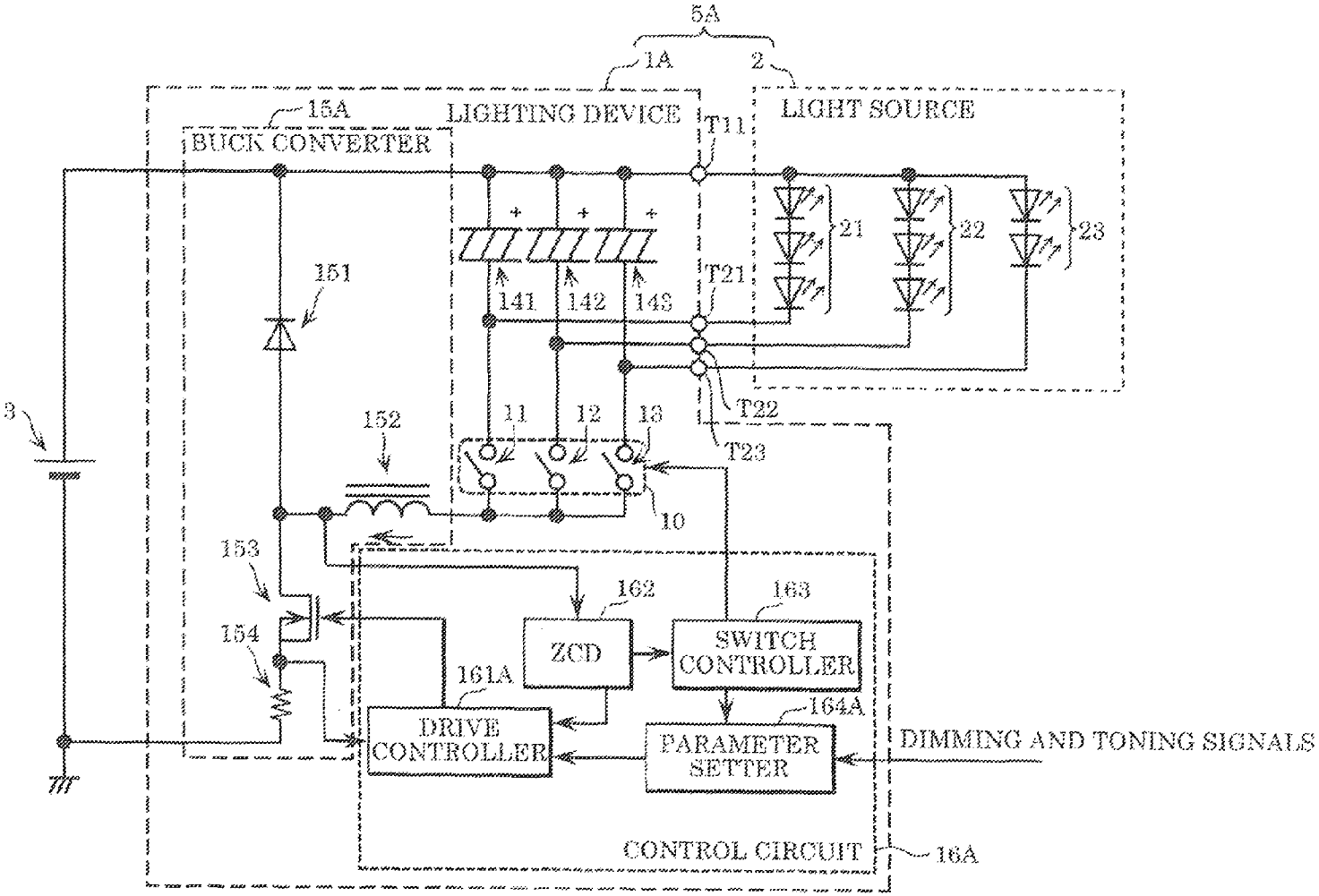
FIG. 3 is a circuit diagram illustrating a configuration of a lighting device and a luminaire including the lighting device according to Embodiment 2.

FIG. 3 is a circuit diagram illustrating the configuration of lighting device 1A and luminaire 5A including lighting device 1A according to this embodiment. FIG. 3 also illustrates DC power supply 3 together with lighting device 1A and luminaire 5A.

As illustrated in FIG. 3, lighting device 1A is different from lighting device 1 according to Embodiment 1 in terms of the configuration of buck converter 15A and control circuit 16A, and is identical in terms of the other structural components.

Buck converter 15A includes rectifier element 151, inductor 152, and first switch element 153 in the same manner as buck converter 15 according to Embodiment 1, and further includes resistor 154.

Resistor 154 is a resistor that makes up a current detector circuit for detecting the current flowing in first switch element 153. The current is detected through the voltage applied to resistor 154.

Control circuit 16A includes drive controller 161A, ZCD 162, switch controller 163, and parameter setter 164A in the same manner as control circuit 16 according to Embodiment 1. Control circuit 16A is different from control circuit 16 in terms of the configuration of drive controller 161A and parameter setter 164A, and is identical in terms of the other structural components.

Parameter setter 164A sets values corresponding to threshold values $Ip_1$, $Ip_2$, and $Ip_3$ for the current flowing in first switch element 153, as the parameters corresponding to the currents to be supplied to light-emitting units 21, 22, and 23, respectively. Each of threshold values $Ip_1$, $Ip_2$, and $Ip_3$ corresponds to a peak value of current flowing in first switch element 153, when current is to be supplied to light-emitting units 21, 22, and 23, respectively.

Drive controller 161A controls first switch element 153 based on threshold values $Ip_1$, $Ip_2$, and $Ip_3$ which are the parameters set by parameter setter 164A. Specifically, when drive controller 161A receives a zero-crossing detection signal from ZCD 162, drive controller 161A causes first switch element 153 to switch to the ON state. Furthermore, drive controller 161A causes first switch element 153 to switch to the OFF state when the current detector circuit configured from resistor 154 detects that the current flowing in first switch element 153 has reached threshold value $Ip_1$, $Ip_2$, or $Ip_3$. For example, when lighting device 1A supplies current to light-emitting unit 21, drive controller 161A keeps first switch element 153 in the ON state from the time when the zero-crossing detection signal is received until the time when the current flowing in first switch element 153 reaches threshold value $Ip_1$. Furthermore, when the current flowing in first switch element 153 has reached threshold value $Ip_1$, drive controller 161A causes first switch element 153 to switch to the OFF state. The same applies in the case where lighting device 1A supplies current to each of light-emitting units 22 and 23.

[2-2. Operation]

Next, operation of lighting device 1A according to this embodiment will be described with reference to the drawings.

Figure 4:
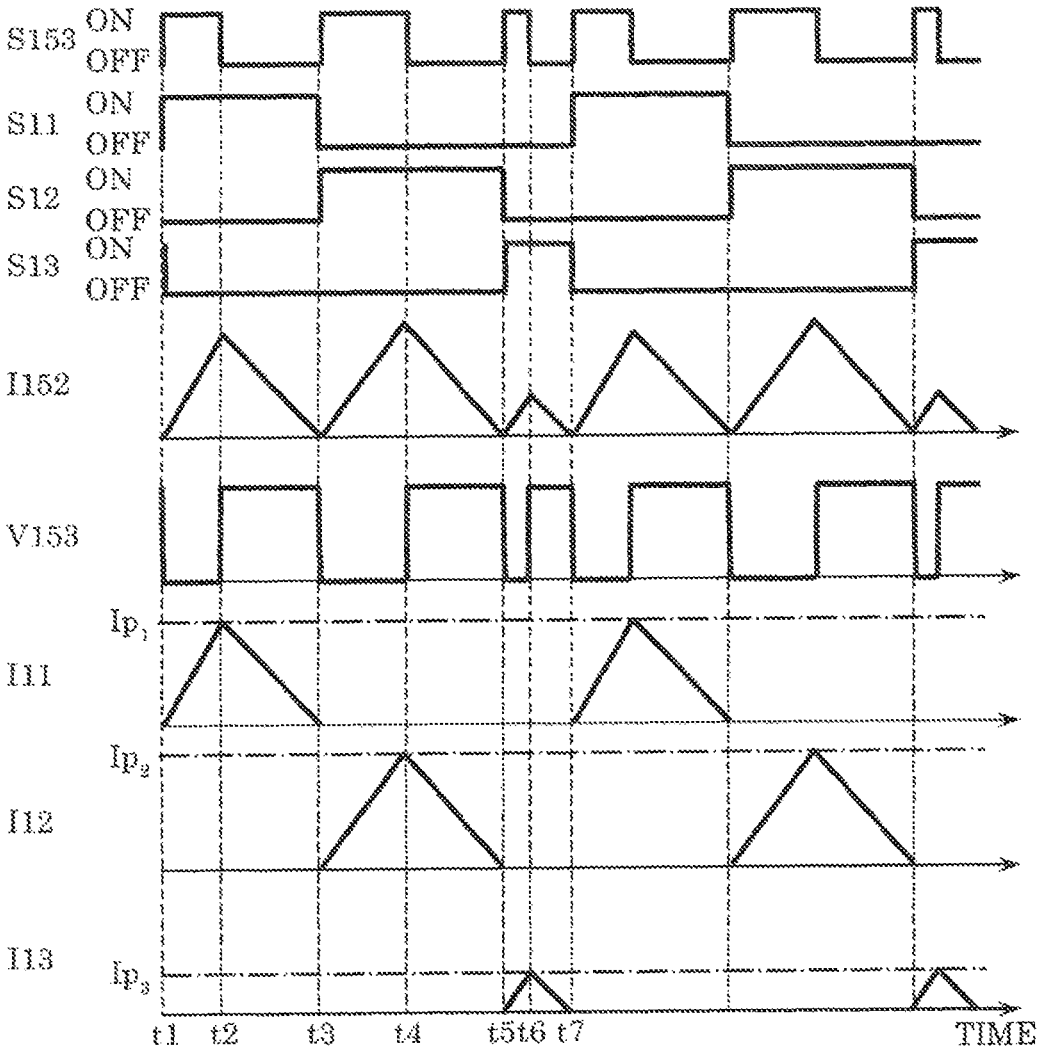
FIG. 4 is a timing chart illustrating an example of an operation of the lighting device according to Embodiment 2.

FIG. 4 is a timing chart illustrating an example of the operation of lighting device 1A according to this embodiment. FIG. 4 illustrates an outline of time waveforms of states S153, S11, S12, and S13, current I152, voltage V153, and currents I11, I12, and I13.

As illustrated in FIG. 4, first, when drive controller 161A causes first switch element 153 to switch to the ON state at time t1, current I152 flowing in inductor 152 gradually increases. Here, when second switching element 11 is kept in the ON state and second switching elements 12 and 13 are kept in the OFF state by switch controller 163, current I11 flowing in second switch element 11 gradually increases.

When drive controller 161A detects that the current flowing in first switch element 153 has reached threshold value $Ip_1$ set by parameter setter 164A (time t2), drive controller 161A causes first switch element 153 to switch to the OFF state. In this case, current flows in the closed circuit configured from inductor 152, rectifier element 151, light-emitting unit 21, and second switch element 11, in the same manner as in lighting device 1 according to Embodiment 1. Furthermore, current I152 flowing in inductor 152 and current I11 flowing in second switch element 11 gradually decrease to become approximately zero. Here, when ZCD 162 detects that current I152 flowing in inductor 152 is approximately zero (time t3), ZCD 162 outputs a zero-crossing detection signal to drive controller 161A and switch controller 163.

As in lighting device 1 according to Embodiment 1, when switch controller 163 receives the zero-crossing detection signal at time t3, switch controller 163 outputs, to switch unit 10, signals for causing second switch element 11 to switch to the OFF state and second switch element 12 to switch to the ON state. It should be noted that second switch element 13 is still kept in the OFF state. Furthermore, switch controller 163 also outputs to parameter setter 164A signals corresponding to the signals outputted to switch unit 10. Based on these signals, parameter setter 164 detects second switch element 12 which is to be switched to the ON state and light-emitting unit 22 corresponding to second switch element 12, and outputs to drive controller 161A a signal corresponding to the current to be supplied to light-emitting unit 22. In this embodiment, parameter setter 164A outputs to drive controller 161A a signal corresponding to threshold value $Ip_2$.

When drive controller 161A receives the zero-crossing detection signal from ZCD 162 at time t3, drive controller 161A causes first switch element 153 to switch to the ON state. This causes current I152 flowing in inductor 152 and current I12 flowing in second switch element 12 to gradually increase.

When drive controller 161A detects that the current flowing in first switch element 153 has reached threshold value $Ip_2$ set by parameter setter 164A (time t4), drive controller 161A causes first switch element 153 to switch to the OFF state. In this case, current flows in the closed circuit configured from inductor 152, rectifier element 151, light-emitting unit 22, and second switch element 12, in the same manner as in lighting device 1 according to Embodiment 1. Furthermore, current I152 flowing in inductor 152 and current I12 flowing in second switch element 12 gradually decrease to become approximately zero. Here, when ZCD 162 detects that current I152 flowing in inductor 152 is approximately zero (time t5), ZCD 162 outputs a zero-crossing detection signal to drive controller 161A and switch controller 163.

As in the case in Embodiment 1, when switch controller 163 receives the zero-crossing detection signal at time t5, switch controller 163 outputs, to switch unit 10, signals for causing second switch element 12 to switch to the OFF state and second switch element 13 to switch to the ON state. It should be noted that second switch element 11 is still kept in the OFF state. Furthermore, switch controller 163 also outputs to parameter setter 164A signals corresponding to the signals outputted to switch unit 10. Based on these signals, parameter setter 164A detects second switch element 13 which is to be switched to the ON state and light-emitting unit 23 corresponding to second switch element 13, and outputs to drive controller 161A a signal corresponding to the current to be supplied to light-emitting unit 23. In this embodiment, parameter setter 164A outputs to drive controller 161A a signal corresponding to threshold value $Ip_3$.

When drive controller 161A receives the zero-crossing detection signal from ZCD 162 at time t5, drive controller 161A causes first switch element 153 to switch to the ON state. This causes current I152 flowing in inductor 152 and current I13 flowing in second switch element 13 to gradually increase.

When drive controller 161A detects that the current flowing in first switch element 153 has reached threshold value $Ip_3$ set by parameter setter 164A (time t6), drive controller 161A causes first switch element 153 to switch to the OFF state. In this case, current flows in the closed circuit configured from inductor 152, rectifier element 151, light-emitting unit 23, and second switch element 13, in the same manner as in lighting device 1 according to Embodiment 1. Furthermore, current I152 flowing in inductor 152 and current I13 flowing in second switch element 13 gradually decrease to become approximately zero. Here, when ZCD 162 detects that current I152 flowing in inductor 152 is approximately zero (time t7), ZCD 162 outputs a zero-crossing detection signal to drive controller 161A and switch controller 163.

As in the case in Embodiment 1, when switch controller 163 receives the zero-crossing detection signal at time t7, switch controller 163 outputs, to switch unit 10, signals for causing second switch element 13 to switch to the OFF state and second switch element 11 to switch to the ON state. It should be noted that second switch element 12 is still kept in the OFF state. Furthermore, switch controller 163 also outputs to parameter setter 164A signals corresponding to the signals outputted to switch unit 10. Based on these signals, parameter setter 164A detects second switch element 11 which is to be switched to the ON state and light-emitting unit 21 corresponding to second switch element 11, and outputs to drive controller 161A a signal corresponding to the current to be supplied to light-emitting unit 21. In this embodiment, parameter setter 164A outputs to drive controller 161A a signal corresponding to threshold value $Ip_1$.

From hereon, lighting device 1A is able to output currents for realizing the dimming level and the toning corresponding to dimming and toning signals, by repeating the same operation.

Here, the current supplied to the respective light-emitting units from lighting device 1A according to this embodiment is reviewed.

In this embodiment, the period in which current is supplied to each light-emitting unit 2*n* (where n is 1, 2, or 3) can be represented by Expression 4 below.

[Math. 4]

$$\frac{Vdc}{VL_n} Ton_n = \frac{Vdc}{VL_n} \frac{L1 \cdot Ip_n}{Vdc - VL_n} \quad \text{(Expression 4)}$$

Here, Vdc denotes the output voltage of DC power supply 3; $VL_n$ denotes the forward voltage of light-emitting unit 2*n*; and $Ton_n$ denotes the ON time of first switch element 153 when current is to be supplied to light-emitting unit 2*n*. Therefore, the cycle in which current is supplied from lighting device 1A to light-emitting units 21, 22, and 23 can be represented by Expression 5 below.

[Math. 5]

$$Vdc \cdot L1 \sum_i \frac{Ip_i}{VL_i \cdot (Vdc - VL_i)} \quad \text{(Expression 5)}$$

Furthermore, average current $IL_n$ in the period in which current is supplied to light-emitting unit 2*n* can be represented by Expression 6 below.

[Math. 6]

$$\begin{aligned} IL_n &= \frac{1}{2} Ip_n \cdot \frac{Vdc}{VL_n} \cdot \frac{L1 \cdot Ip_n}{Vdc - VL_n} \Big/ Vdc \cdot L1 \sum_i \frac{Ip_i}{VL_i \cdot (Vdc - VL_i)} \\ &= \frac{1}{2} \frac{Ip_n^2}{VL_n \cdot (Vdc - VL_n)} \Big/ \sum_i \frac{Ip_i}{VL_i \cdot (Vdc - VL_i)} \end{aligned} \quad \text{(Expression 6)}$$

As described above, since average current $IL_n$ is not dependent on inductance L1, the error from the design value of average current $IL_n$ caused by inductor 152 manufacturing error, etc., is suppressed. Therefore, based on Expression 6 above, the average current flowing in light-emitting unit 2*n* is proportional to the value represented by Expression 7 below.

[Math. 7]

$$\frac{Ip_n^2}{VL_n \cdot (Vdc - VL_n)} \quad \text{(Expression 7)}$$

Therefore, average current $IL_n$ flowing in light-emitting unit 2*n* is generally proportional to the square of $Ip_n$.

[2-3. Advantageous Effect, Etc.]

Because lighting device 1A according to this embodiment is configured in the manner described above, lighting device 1A produces the same advantageous effects as lighting device 1 according to Embodiment 1.

Furthermore, lighting device 1A further includes a current detector circuit which detects the current flowing in first switch element 153; and drive controller 161A which controls first switch element 153 based on parameters. Furthermore, parameter setter 164A sets a value corresponding to the threshold value of current flowing in first switch element 153. Furthermore, when drive controller 161A receives a zero-crossing detection signal from ZCD 162, drive controller 161A causes first switch element 153 to switch to the ON state. In addition, when the current detector circuit detects that the current flowing in first switch element 153 has reached the threshold value, drive controller 161A causes first switch element 153 to switch to the OFF state.

Accordingly, as described above, since the current supplied to the light-emitting unit is not dependent on the inductance of inductor 152, the error from the design value of average current IL caused by inductor 152 manufacturing error, etc., can be suppressed.

Embodiment 3

Next, a lighting device and a luminaire according to Embodiment 3 will be described. The lighting device and luminaire according to this embodiment is different from lighting device 1A and luminaire 5A in Embodiment 2 in terms of the configuration of the switch unit and the switching controller that controls the switch unit.

Hereinafter, the lighting device and the luminaire according to this embodiment will be described focusing on structural components that are different from those in lighting device 1A and luminaire 5A according to Embodiment 2, and description of common structural components will be omitted for the sake of brevity.

[3-1. Configuration]

First, a configuration of the lighting device and the luminaire according to this embodiment will be described with reference to the drawings.

Figure 5:
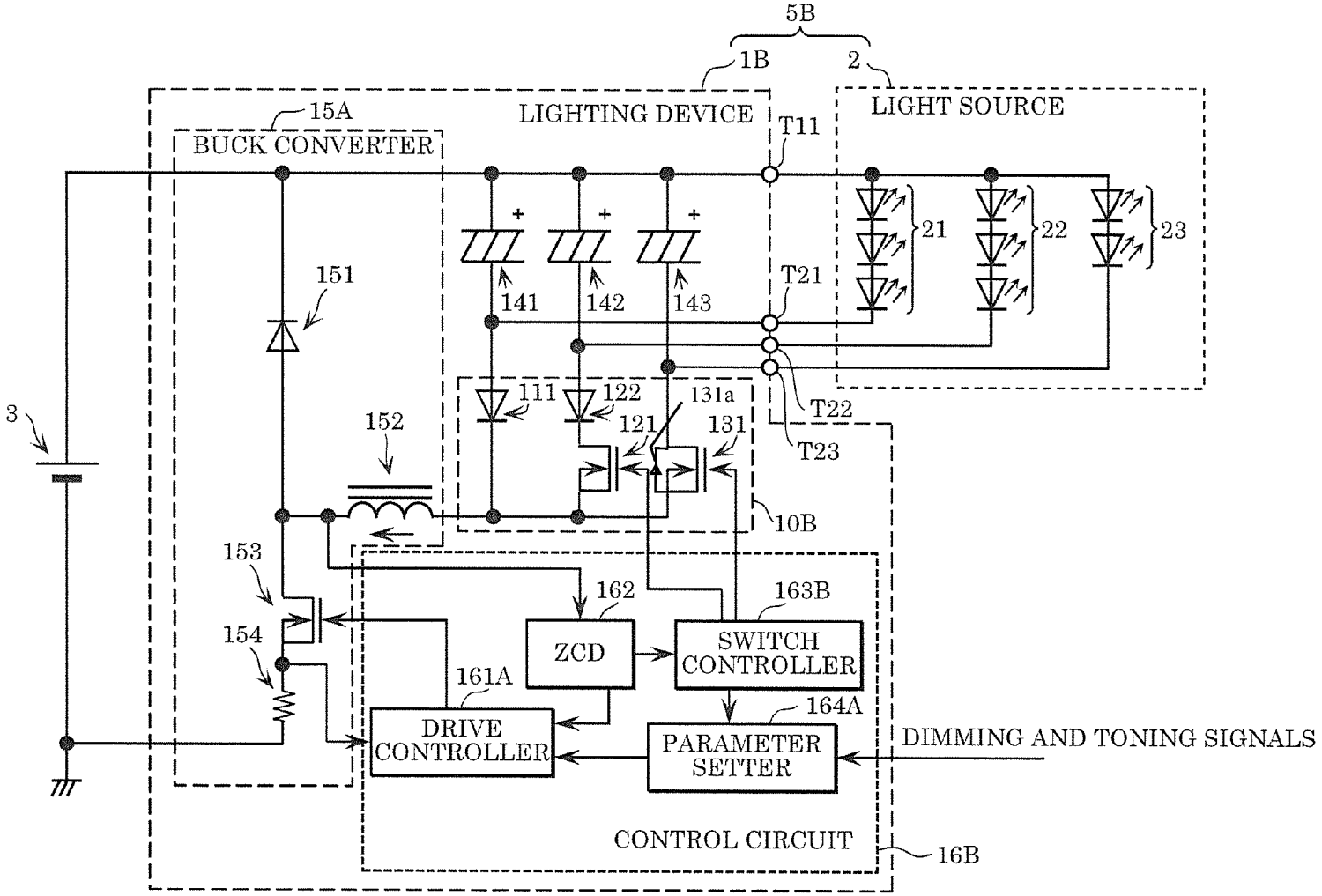
FIG. 5 is a circuit diagram illustrating a configuration of a lighting device and a luminaire including the lighting device according to Embodiment 3.

FIG. 5 is a circuit diagram illustrating the configuration of lighting device 1B and luminaire 5B including lighting device 1B according to this embodiment. FIG. 5 also illustrates DC power supply 3 together with lighting device 1B and luminaire 5B.

As illustrated in FIG. 5, lighting device 1B is different from lighting device 1A according to Embodiment 1 in terms of the configuration of switch unit 10B and switch controller 163B in control circuit 16B, and is identical in terms of the other structural components.

It should be noted that, in this embodiment, the respective forward voltages of light-emitting units 21, 22, and 23 also decrease in the order of light-emitting unit 21, then light-emitting unit 22, then light-emitting unit 23, in the same manner as in the foregoing embodiments.

Switch unit 10B includes second switch elements 111, 121, and 131, and rectifier element 122.

Second switch element 111 is an element connected to light-emitting unit 21 which has the highest forward voltage among plural light-emitting units 21, 22, and 23. In this embodiment, second switch element 111 is configured of a rectifier element such as a diode.

As in lighting device 1A in Embodiment 2, second switch elements 121 and 131 are elements that can be controlled to switch to the ON and OFF states according to signals from switch controller 163B. In this embodiment, second switch elements 121 and 131 are configured of MOSFETs. Furthermore, a rectifier element 131*a* is connected in reverse parallel to second switch element 131 connected to light-emitting unit 23 which has the lowest forward voltage among plural light-emitting units 21, 22, and 23. This rectifier element 131*a* may be configured of a parasitic diode of second switch element 131 or may be configured of a rectifier element such as a diode connected in reverse parallel to second switch element 131.

Rectifier element 122 is an element connected in series with second switch element 121. Rectifier element 122 is configured of a diode, for example.

In the same manner as switch controller 163 in each of the foregoing embodiments, switch controller 163B selects one light-emitting unit from among light-emitting units 21, 22, and 23, each time switch controller 163B receives a zero-crossing detection signal from ZCD 162. In this embodiment, when selecting light-emitting unit 22 or 23, switch controller 163B outputs a signal for causing second switch element 121 or 131 to switch to the ON state, in the same manner as in the foregoing embodiments. In this case, since the forward voltage of light-emitting unit 21 is the highest among the forward voltages of the respective light-emitting units, voltage greater than or equal to the forward voltage is not applied to light-emitting unit 21 when current flows in the other light-emitting units. Therefore, in this case, current does not flow in light-emitting unit 21. On the other hand, when selecting light-emitting unit 21, switch controller 163B outputs signals for causing second switch elements 121 and 131 to switch to the OFF state. In this state, the outputting of current from buck converter 15A causes voltage greater than or equal to the forward voltage to be applied to each of light-emitting unit 21 and second switch element 111, and thus second switch element 111 switches to the ON state.

Here, the action, etc. of switch unit 10B according to this embodiment will be described in detail.

In this embodiment, immediately before first switch element 153 switches from the OFF state to the ON state, the light-emitting unit to be supplied with current is switched by switch unit 10B. Here, a review is carried out for the case where first switch element 153 is in the OFF state, the current of inductor 152 has reached zero, and the polarity of inductor 152 reverses. In this case, current flows in the closed circuit starting from inductor 152, then sequentially passing through switch unit 10B, the parallel circuit configured of light source 2 and the respective smoothing capacitors, DC power supply 3, and first switch element 153, then returning to inductor 152, and the electrical charge of first switch element 153 is released. In order that first switch element 153 can switch to the ON state when the electrical charge of first switch element 153 becomes approximately zero or minimum, it is advisable to adjust the time from when zero current is detected to when a zero-crossing detection signal is outputted to drive controller 161A by ZCD 162.

However, if adjusting is performed as described above, a closed circuit that negates the difference among the voltages applied to the respective light-emitting units is formed when first switch element 153 is in the ON state at the timing at which the light-emitting unit to be supplied with current is switched by switch unit 10B. In order to suppress this, connecting a rectifier element in series with each second switch element is effective. It should be noted that, in this embodiment, second switch element 111 is configured of a rectifier element, and thus a separate rectifier element need not be provided to second switch element 111. Furthermore, since there is no risk of backflow of current to other light-emitting units from light-emitting unit 23 which has the lowest forward voltage, a rectifier element is not connected in series with second switch element 131 which is connected in series with light-emitting unit 23. Furthermore, by providing a rectifier element in reverse parallel and not connecting a rectifier element in series to second switch element 131, the opening of the above-described closed circuit formed when the polarity of inductor 152 reverses is suppressed even when all the second switch elements are in the OFF state. Accordingly, when first switch element 153 is switched to the OFF state, a closed circuit which discharges the electrical charge of first switch element 153 is secured. Therefore, reduction of switching loss and noise can be realized by adjusting the timing at which first switch element 153 is switched to the ON state as described above.

In addition, as described above, second switch element 111 connected to light-emitting unit 21 having the highest forward voltage among plural light-emitting units 21, 22, and 23 is configured of only a rectifier element. This allows the configuration of switch unit 10B and switch controller 163 to be simplified.

[3-2. Operation]

Next, operation of lighting device 1B according to this embodiment will be described with reference to the drawings.

Figure 6:
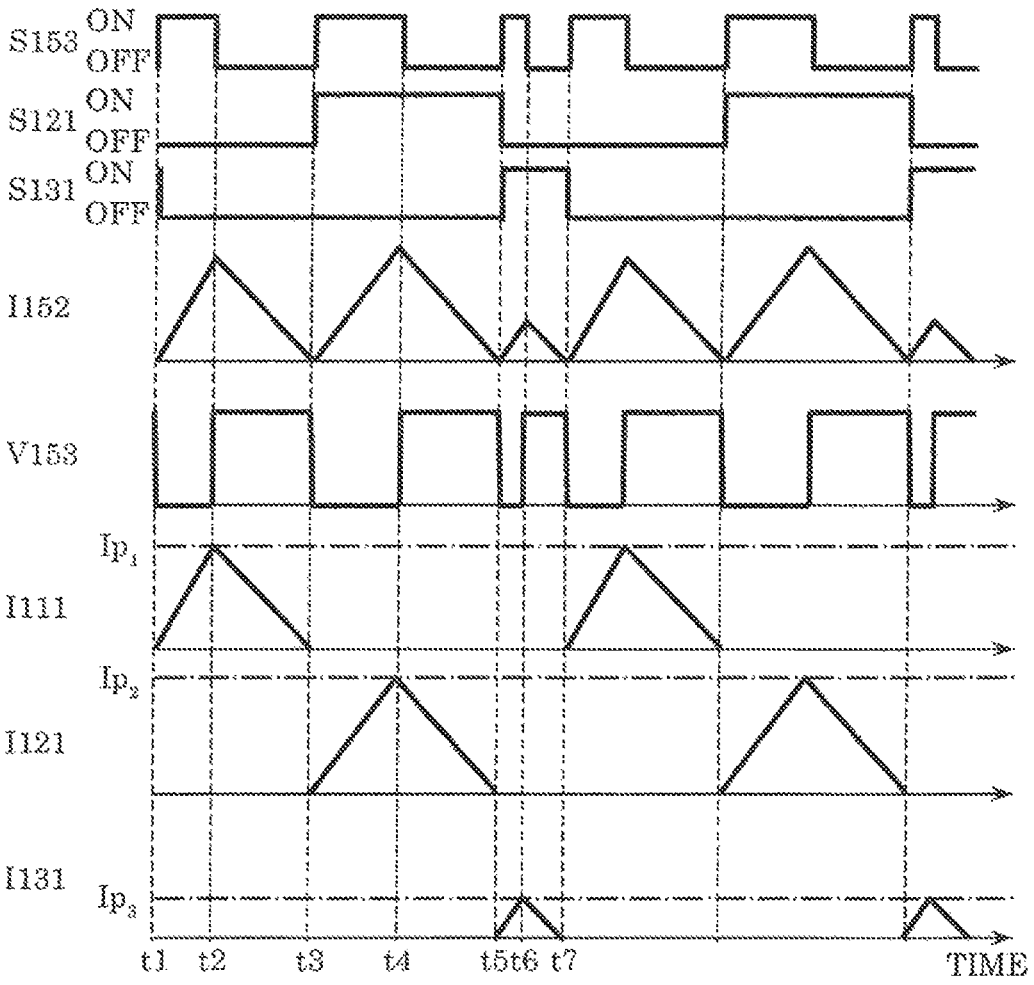
FIG. 6 is a timing chart illustrating an example of an operation of the lighting device according to Embodiment 3.

FIG. 6 is a timing chart illustrating an example of the operation of lighting device 1B according to this embodiment. As in FIG. 2 and FIG. 4, FIG. 6 illustrates an outline of time waveforms of states S153, current I152, and voltage V153. Furthermore, FIG. 6 also illustrates an outline of time waveforms of states S121 and S131 of second switch elements 121 and 131, respectively, and currents I111, I121, and I131 flowing in second switch elements 111, 121, and 131, respectively.

As illustrated in FIG. 6, first, when drive controller 161A causes first switch element 153 to switch to the ON state at time t1, current I152 flowing in inductor 152 gradually increases. Here, when second switch elements 121 and 131 are kept in the OFF state by switch controller 163B, current I111 flowing in second switch element 111 gradually increases.

When drive controller 161A detects that the current flowing in first switch element 153 has reached threshold value $Ip_1$ set by parameter setter 164A (time t2), drive controller 161A causes first switch element 153 to switch to the OFF state. In this case, current flows in the closed circuit configured from inductor 152, rectifier element 151, light-emitting unit 21, and second switch element 111. Furthermore, current I152 flowing in inductor 152 and current I111 flowing in second switch element 111 gradually decrease to become approximately zero. Here, when ZCD 162 detects that current I152 is approximately zero (time t3), ZCD 162 outputs a zero-crossing detection signal to drive controller 161A and switch controller 163B.

When switch controller 163B receives the zero-crossing detection signal at time t3, switch controller 163B outputs to switch unit 10B a signal for causing second switch element 121 to switch to the ON state. It should be noted that second switch element 131 is still kept in the OFF state. Furthermore, switch controller 163B also outputs to parameter setter 164A a signal corresponding to the signal outputted to switch unit 10B. Based on this signal, parameter setter 164A detects second switch element 121 which is to be switched to the ON state and light-emitting unit 22 corresponding to second switch element 121, and outputs to drive controller 161A a signal corresponding to the current to be supplied to light-emitting unit 22. In this embodiment, parameter setter 164A outputs to drive controller 161A a signal corresponding to threshold value $Ip_2$.

When drive controller 161A receives the zero-crossing detection signal from ZCD 162 at time t3, drive controller 161A causes first switch element 153 to switch to the ON state. This causes current I152 flowing in inductor 152 and current I121 flowing in second switch element 121 to gradually increase.

When drive controller 161A detects that the current flowing in first switch element 153 has reached threshold value $Ip_2$ set by parameter setter 164A (time t4), drive controller 161A causes first switch element 153 to switch to the OFF state. In this case, current flows in the closed circuit configured from inductor 152, rectifier element 151, light-emitting unit 22, rectifier element 122, and second switch element 121. Furthermore, current I152 flowing in inductor 152 and current I121 flowing in second switch element 121 gradually decrease and become approximately zero. Here, when ZCD 162 detects that current I152 flowing in inductor 152 is approximately zero (time t5), ZCD 162 outputs a zero-crossing detection signal to drive controller 161A and switch controller 163B.

When switch controller 163B receives the zero-crossing detection signal at time t5, switch controller 163B outputs to switch unit 10B signals for causing second switch element 121 to switch to the OFF state and second switch element 131 to switch to the ON state. Furthermore, switch controller 163B also outputs to parameter setter 164A signals corresponding to the signals outputted to switch unit 10B. Based on these signals, parameter setter 164A detects second switch element 131 which is to be switched to the ON state and light-emitting unit 23 corresponding to second switch element 131, and outputs to drive controller 161A a signal corresponding to the current to be supplied to light-emitting unit 23. In this embodiment, parameter setter 164A outputs to drive controller 161A a signal corresponding to threshold value $Ip_3$.

When drive controller 161A receives the zero-crossing detection signal from ZCD 162 at time t5, drive controller 161A causes first switch element 153 to switch to the ON state. This causes current I152 flowing in inductor 152 and current I131 flowing in second switch element 131 to gradually increase.

When drive controller 161A detects that the current flowing in first switch element 153 has reached threshold value $Ip_3$ set by parameter setter 164A (time t6), drive controller 161A causes first switch element 153 to switch to the OFF state. In this case, current flows in the closed circuit configured from inductor 152, rectifier element 151, light-emitting unit 23, and second switch element 131. Furthermore, current I152 flowing in inductor 152 and current I131 flowing in second switch element 131 gradually decrease and become approximately zero. Here, when ZCD 162 detects that current I152 flowing in inductor 152 is approximately zero (time t7), ZCD 162 outputs a zero-crossing detection signal to drive controller 161A and switch controller 163B.

When switch controller 163B receives the zero-crossing detection signal at time t7, switch controller 163B outputs to switch unit 10B a signal for causing second switch element 131 to switch to the OFF state. It should be noted that second switch element 121 is still kept in the OFF state. Furthermore, switch controller 163B also outputs to parameter setter 164A a signal corresponding to the signal outputted to switch unit 10B. Based on this signal, parameter setter 164A detects second switch element 111 which is to be switched to the ON state and light-emitting unit 21 corresponding to second switch element 111, and outputs to drive controller 161A a signal corresponding to the current supplied to light-emitting unit 21. In this embodiment, parameter setter 164A outputs to drive controller 161A a signal corresponding to threshold value $Ip_1$.

From hereon, lighting device 1B is able to output currents for realizing the dimming level and the toning corresponding to dimming and toning signals, by repeating the same operation.

Furthermore, as described above, in this embodiment, switch controller 163B selects one light-emitting unit to be supplied with current, based on a predetermined order. Here, the predetermined order is an order which goes around in a descending order starting from light-emitting unit 21 which has the highest forward voltage among plural light-emitting units 21, 22, and 23. Accordingly, for example, when the light-emitting unit to be supplied with current is switched from light-emitting unit 21 to light-emitting unit 22, an electrical charge corresponding to the voltage difference between forward voltage $VL_1$ of light-emitting unit 21 and forward voltage $VL_2$ of light-emitting unit 22 is stored in second switch element 121. Since this electrical charge is discharged when the polarity of inductor 152 is reversed, a small voltage difference becomes zero while the polarity of inductor 152 reverses. Furthermore, even when it is not possible to make the voltage difference zero, a smaller voltage difference allows for greater reduction of switching loss. Therefore, since this embodiment allows voltage difference to be reduced, switching loss can be reduced. It should be noted that, when the light-emitting unit to be supplied with current is switched from light-emitting unit 23 having forward voltage $VL_3$ to light-emitting unit 21 having forward voltage $VL_1$, a voltage which is a reverse voltage and equivalent to the voltage difference between forward voltage $VL_1$ and forward voltage $VL_3$ is applied to second switch element 111. Since the electrical charge that is stored due to the application of this voltage is discharged via inductor 152 when first switch element 153 is switched to the ON state, there is no risk of surge current generation.

It should be noted that the operation of lighting device 1B according to this embodiment is not limited to the above-described operation. Here, another example of the operation of lighting device 1B according to this embodiment will be described with reference to the drawings.

Figure 7:
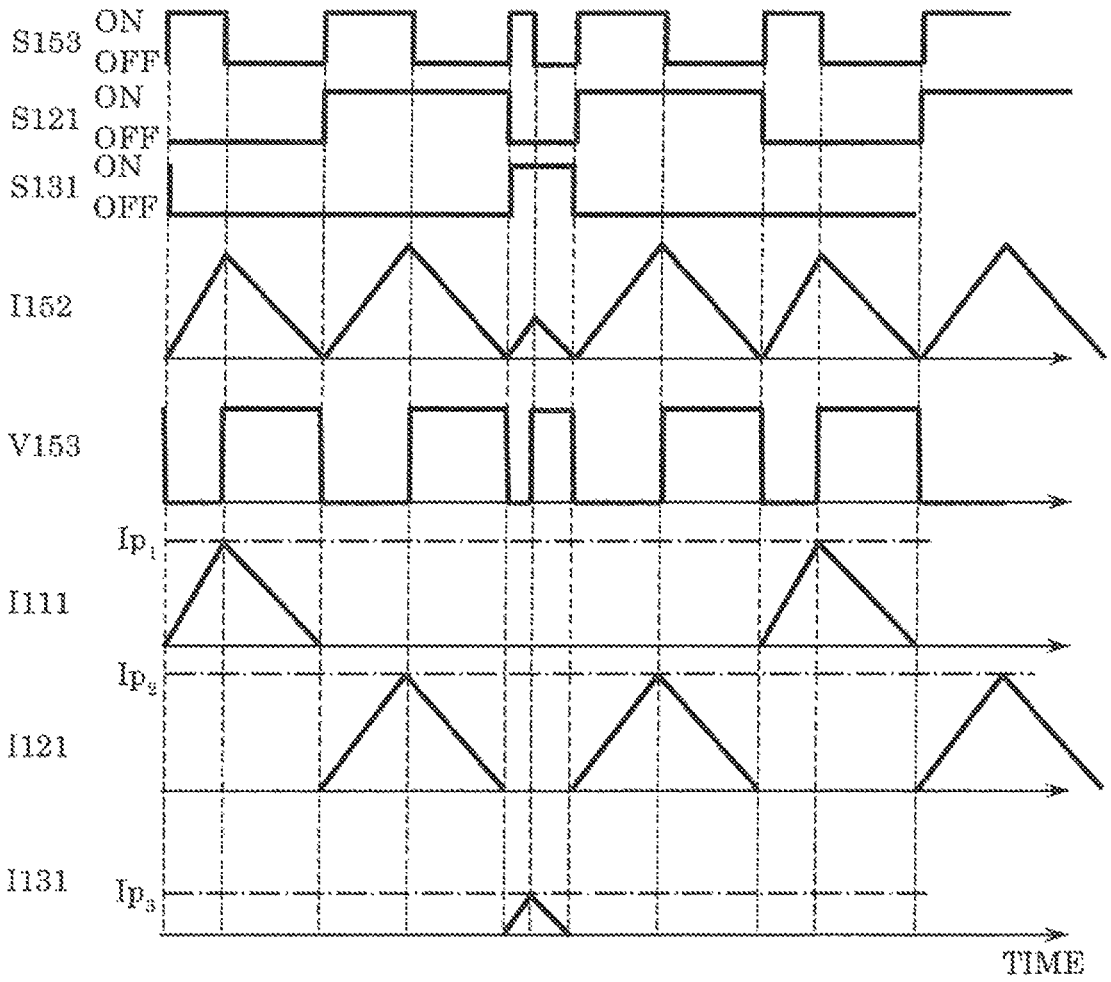
FIG. 7 is a timing chart illustrating another example of an operation of the lighting device according to Embodiment 3.

FIG. 7 is a timing chart illustrating another example of the operation of lighting device 1B according to this embodiment. As in FIG. 6, FIG. 7 illustrates an outline of time waveforms of states S153, S121, and S131, current I152, voltage V153, and currents I111, I121, and I131.

Likewise, in this operation example, switch controller 163B selects one light-emitting unit to be supplied with current, based on a predetermined order, as illustrated in FIG. 7. Here, the predetermined order is an order which alternately repeats between (i) going around in a descending order starting from light-emitting unit 21 which has the highest forward voltage among plural light-emitting units 21, 22, and 23 and (ii) going around in an ascending order starting from light-emitting unit 23 which has the lowest forward voltage among plural light-emitting units 21, 22, and 23.

Like the operation example illustrated in FIG. 6, this operation example also allows for suppression of the amount of change of forward voltage accompanying the switching of the light-emitting unit to be supplied with current, and thus switching loss can be reduced. Furthermore, this operation example does not have the switching of current supply from light-emitting unit 23 to light-emitting unit 21 such as that in the operation example illustrated in FIG. 6. As such, the amount of increase in forward voltage accompanying the switching of the light-emitting unit to be supplied with current can be suppressed more than in the operation example illustrated in FIG. 6. Therefore, the stress, noise, etc., caused by application of reverse voltage to the respective elements can be suppressed.

It should be noted that, in the operation example illustrated in FIG. 7, during one round of shifting of the light-emitting unit to be supplied with current, light-emitting units 21 and 23 are supplied with current only once, whereas light-emitting unit 22 is supplied with current twice. As such, the current to be supplied to each light-emitting unit needs to be determined with consideration given to the above-described difference in the number of times current is supplied. For example, for the light-emitting unit that is supplied with current twice during one round, it is possible to use a light-emitting unit including a solid-state light-emitting element with low light-emitting efficiency or a light-emitting unit for which the current amount set according to a toning signal is largest, etc.

[3-3. Advantageous Effect, Etc.]

Because lighting device 1B according to this embodiment is configured in the manner described above, lighting device 1B also produces the same advantageous effects as lighting device 1A according to Embodiment 2.

Furthermore, in lighting device 1B, smoothing capacitors are connected in parallel to the plural light-emitting units, respectively; and a rectifier element is connected in reverse parallel to second switch element 131 which is connected to light-emitting unit 23 having the lowest forward voltage among the plural light-emitting units.

Accordingly, the opening of the closed circuit formed when the polarity of inductor 152 reverses can be suppressed even if second switch elements 111, 121, and 131 are all in the OFF state. Accordingly, when first switch element 153 is switched to the OFF state, the closed circuit which discharges the electrical charge of first switch element 153 is secured. Therefore, reduction of switching loss and noise can be realized by adjusting the timing at which first switch element 153 is switched to the ON state as described above.

Furthermore, in lighting device 1B, smoothing capacitors are connected in parallel to the plural light-emitting units, respectively; and second switch element 111, which is connected in series with light-emitting unit 21 having the highest forward voltage among the plural light-emitting units, is configured of a rectifier element.

This allows the configuration of switch unit 10B and switch controller 163B to be simplified.

Furthermore, in lighting device 1B, switch controller 163B selects one of the light-emitting units based on a predetermined order. Here, the aforementioned order is an order which goes around in a descending order starting from light-emitting unit 21 which has the highest forward voltage among the plural light-emitting units.

This allows for suppression of the amount of change of forward voltage accompanying the switching of the light-emitting unit to be supplied with current, and thus switching loss can be reduced.

Furthermore, in lighting device 1B, switch controller 163B selects one of the light-emitting units based on a predetermined order. Here, the predetermined order may be an order which alternately repeats between (i) going around in a descending order starting from light-emitting unit 21 which has the highest forward voltage among the plural light-emitting units and (ii) going around in an ascending order starting from light-emitting unit 23 which has the lowest forward voltage among the plural light-emitting units.

This allows for suppression of the amount of change of forward voltage accompanying the switching of the light-emitting unit to be supplied with current, and thus switching loss can be reduced. In addition, with this order, the amount of increase in forward voltage accompanying the switching of the light-emitting unit to be supplied with current can also be suppressed. Therefore, the stress, noise, etc., caused by application of reverse voltage to the respective elements can be suppressed.

Embodiment 4

Next, a lighting device and a luminaire according to Embodiment 4 will be described. The lighting device according to this embodiment has the same circuit configuration as lighting device 1 according to Embodiment 1 illustrated in FIG. 1, and is different from lighting device 1 according to Embodiment 1 in terms of the form of the control by switch controller 163.

Hereinafter, the lighting device and the luminaire according to this embodiment will be described focusing on structural components that are different from those in lighting device 1 and luminaire 5 according to Embodiment 1, and description of common structural components will be omitted for the sake of brevity.

[4-1. Operation]

Next, operation of the lighting device according to this embodiment will be described with reference to the drawings.

Figure 8:
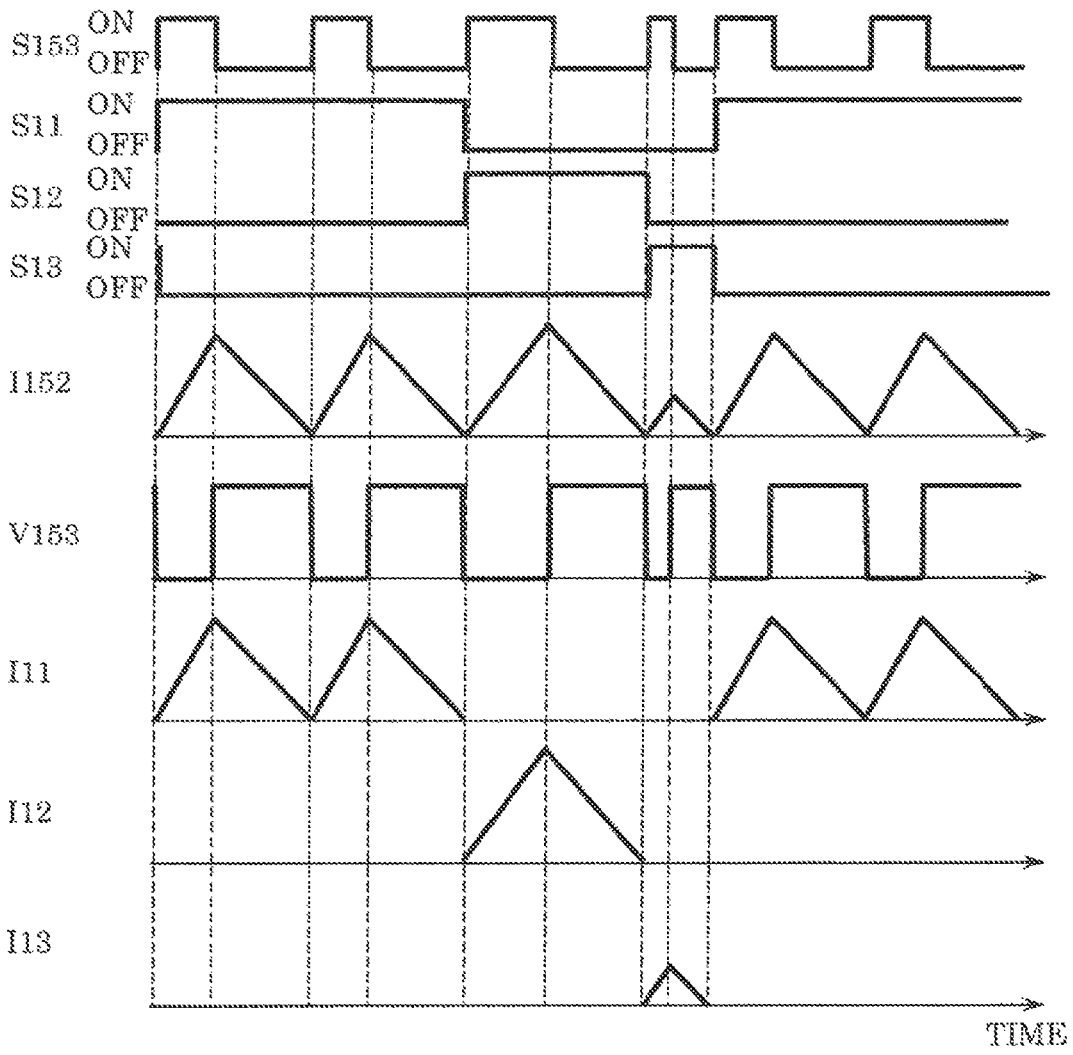
FIG. 8 is a timing chart illustrating an example of an operation of a lighting device according to Embodiment 4.

FIG. 8 is a timing chart illustrating an example of the operation of the lighting device according to this embodiment. FIG. 8 illustrates an outline of time waveforms of states S153, S11, 812, and S13, current I152, voltage V153, and currents I11, I12, and I13.

As illustrated in FIG. 8, in the lighting device according to this embodiment, the light-emitting unit that is supplied with current is not necessarily switched at each switching cycle of first switch element 153. Specifically, the switch controller of the lighting device according to this embodiment keeps second switch element 11, which is connected in series with light-emitting unit 21, in the ON state over two switching cycles of first switch element 153. Accordingly, current is supplied to light-emitting unit 21 over two switching cycles of first switch element 153.

In this embodiment, supplying current over plural cycles to a light-emitting unit which includes a solid-state light-emitting element with low light-emitting efficiency or a light-emitting unit for which the current amount set according to a toning signal is largest, etc., allows the output from such light-emitting unit to be increased. Furthermore, the lighting device according to this embodiment is effective when a big difference in the currents to be supplied to the respective light-emitting units is desired, that is, when a big difference in the intensity of light emitted by the respective light-emitting units is desired.

[4-2. Advantageous Effect, Etc.]

Because the lighting device according to this embodiment is configured in the manner described above, the lighting device also produces the same advantageous effects as lighting device 1 according to Embodiment 1.

Furthermore, in lighting device 1B, the switch controller selects one of the light-emitting units based on a predetermined order. Here, the predetermined order is an order in which part of the plural light-emitting units is selected continuously for plural cycles at a time and the remainder of the light-emitting units is selected one cycle at a time.

This allows the difference in the current to be supplied to the respective light-emitting units to be increased. Therefore, in a luminaire using this lighting device, the difference in the intensity of light emitted by the respective light-emitting units can be increased, and thus the toning range can be broadened.

Embodiment 5

Next, a lighting device and a luminaire according to Embodiment 5 will be described. The lighting device according to this embodiment is different from lighting device 1 according to Embodiment 1 in terms of the configuration of the control circuit.

Hereinafter, the lighting device and the luminaire according to this embodiment will be described focusing on structural components that are different from those in lighting device 1 and luminaire 5 according to Embodiment 1, and description of common structural components will be omitted for the sake of brevity.

[5-1. Configuration]

First, a configuration of the lighting device and the luminaire according to this embodiment will be described with reference to the drawings.

Figure 9:
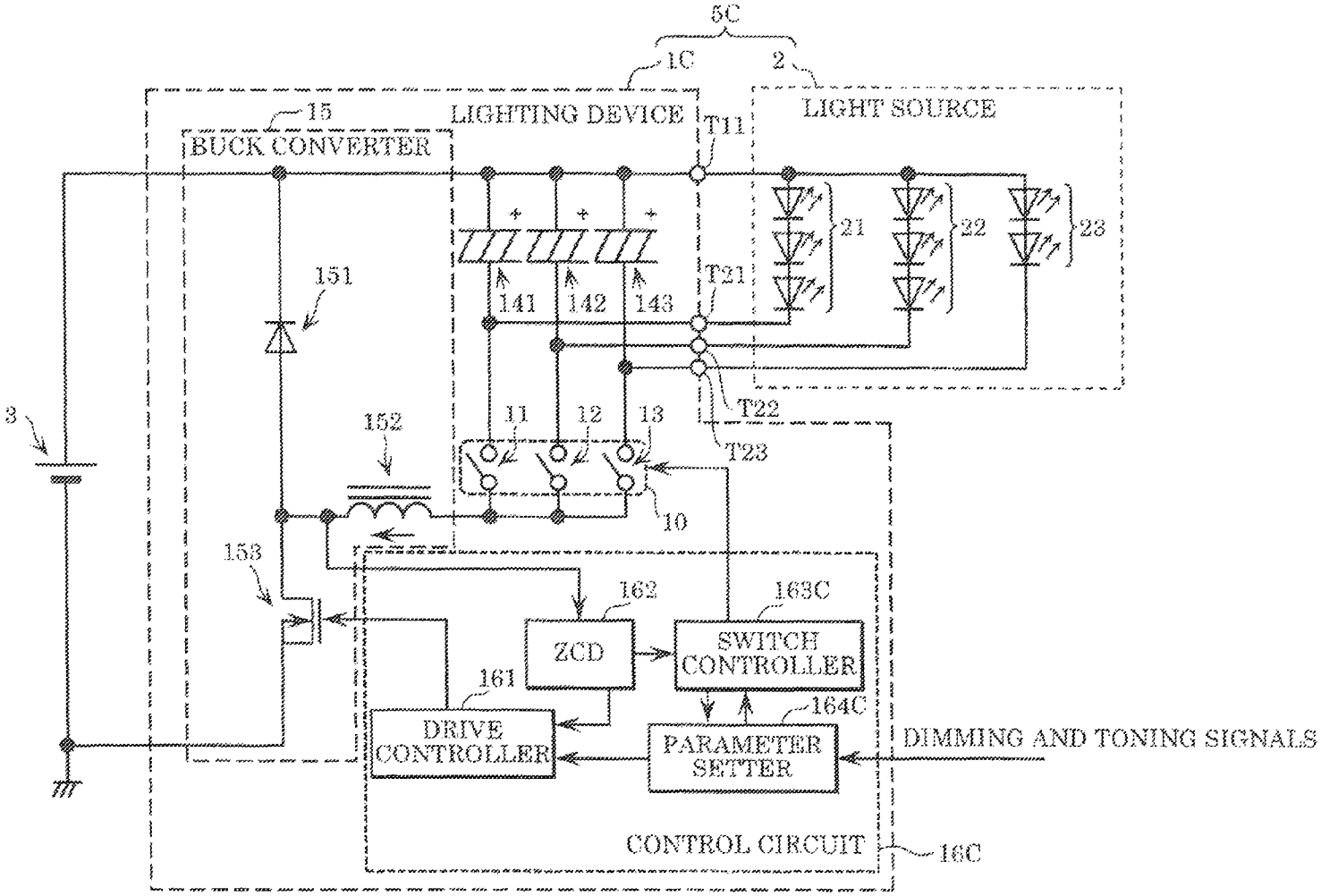
FIG. 9 is a circuit diagram illustrating a configuration of a lighting device and a luminaire including the lighting device according to Embodiment 5.

FIG. 9 is a circuit diagram illustrating the configuration of lighting device 1C and luminaire 5C including lighting device 1C according to this embodiment. FIG. 9 also illustrates DC power supply 3 together with lighting device 1C and luminaire 5C.

As illustrated in FIG. 9, lighting device 1C is different from lighting device 1 according to Embodiment 1 in terms of the configuration of switch controller 163C and parameter setter 164C of control circuit 16C, and is identical in terms of the other structural components.

Parameter setter 164C performs the same processing as parameter setter 164 in Embodiment 1. In addition, parameter setter 164C sets parameters corresponding to the respective light-emitting units, and outputs signals corresponding to the parameters to switch controller 163C.

Switch controller 163C controls switch unit 10 in the same manner as switch controller 163 according to Embodiment 1, and outputs to parameter setter 164C a signal indicating the next light-emitting unit to be supplied with current. In addition, switch controller 163C receives the signals corresponding to the parameters from parameter setter 164C and performs control to prohibit the switching to the ON state of the second switching element which is connected in series to the light-emitting unit for which the parameter is below a lower limit value. For example, in the case where switching controller 163C is configured of a sequential circuit, when the turn of the second switch element that is not to be switched to the ON state comes, switch controller 163C advances a counter once to cause the next second switch element to switch to the ON state

[5-2. Operation]

Next, operation of lighting device 1C according to this embodiment will be described with reference to the drawings.

Figure 10:
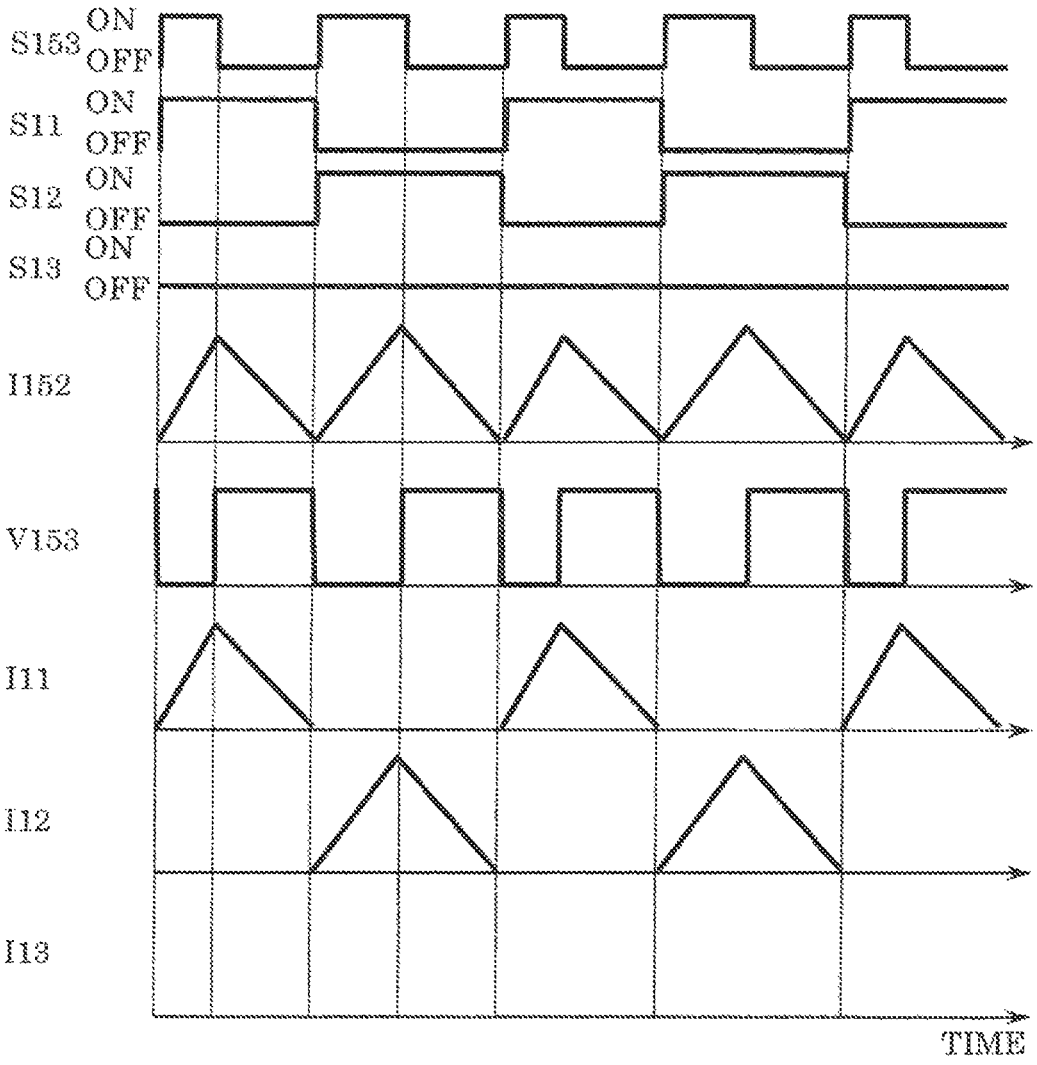
FIG. 10 is a timing chart illustrating an example of an operation of a lighting device according to Embodiment 5.

FIG. 10 is a timing chart illustrating an example of the operation of lighting device 1C according to this embodiment. As in FIG. 2, FIG. 10 illustrates an outline of time waveforms of states S153, S11, S12, and S13, current 152, voltage V153, and currents I11, I12, and I13.

The example illustrated in FIG. 10 illustrates a timing chart for the case where the parameter (in this embodiment, ON time $Ton_3$) corresponding to the current to be supplied to light-emitting unit 23 is below a predetermined lower limit value.

As illustrated in FIG. 10, in this operation example, the parameter corresponding to the current to be supplied to light-emitting unit 23 is below the predetermined lower limit value, and thus switch controller 163C keeps second switch element 13, which is connected in series with light-emitting unit 23, in the OFF state. Therefore, switch controller 163C alternately causes only second switch elements 11 and 12 to switch to the ON state.

By performing the operation described above, lighting device 1C can suppress destabilization of the switching operation which occurs when the ON time of first switch element 153 becomes too short in the case where the current to be supplied to a certain light-emitting unit is small.

[5-3. Advantageous Effect, Etc.]

Because lighting device 1C according to this embodiment is configured in the manner described above, lighting device 1C also produces the same advantageous effects as lighting device 1 according to Embodiment 1.

Furthermore, in lighting device 1C according to this embodiment, in the case where a parameter is below a predetermined lower limit value, switch controller 163C does not select, as the light-emitting unit to be supplied with current, the light-emitting unit which is to be supplied with the current corresponding to the parameter.

Accordingly, lighting device 1C can suppress destabilization of the switching operation which occurs when the ON time of first switch element 153 becomes too short in the case where the current to be supplied to a certain light-emitting unit is small.

Embodiment 6

Next, a lighting device and a luminaire according to Embodiment 6 will be described. The lighting device according to this embodiment has a configuration for further suppressing unevenness in the ratio of current supplied to each of the light-emitting units.

Hereinafter, the lighting device and the luminaire according to this embodiment will be described focusing on structural components that are different from those in lighting device 1B and luminaire 5B according to Embodiment 1, and description of common structural components will be omitted for the sake of brevity.

[6-1. Configuration]

First, a configuration of the lighting device and the luminaire according to this embodiment will be described with reference to the drawings.

Figure 11:
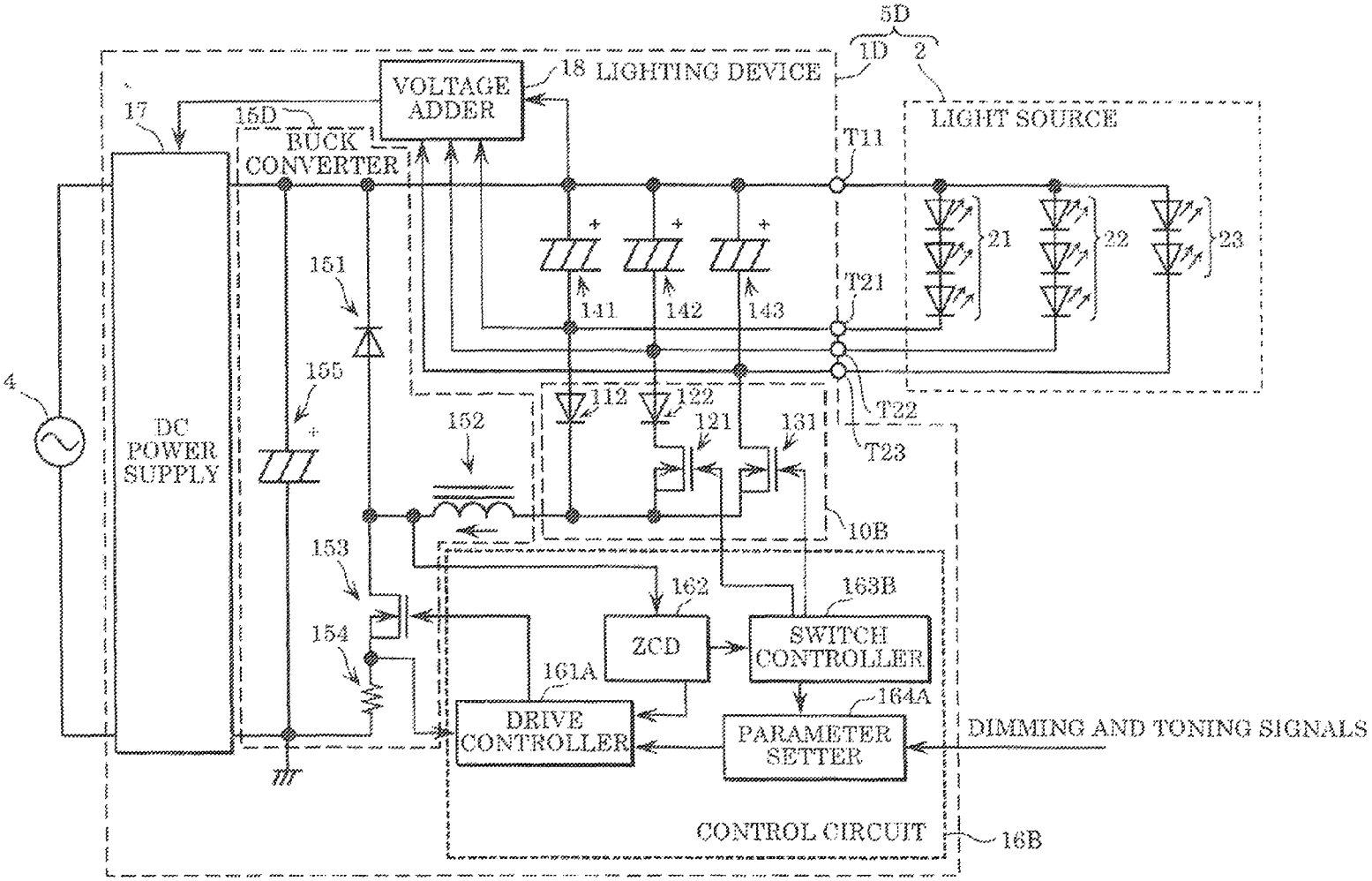
FIG. 11 is a circuit diagram illustrating a configuration of a lighting device and a luminaire including the lighting device according to Embodiment 6.

FIG. 11 is a circuit diagram illustrating the configuration of lighting device 1D and luminaire 5D including lighting device 1D according to this embodiment. FIG. 11 also illustrates alternating current (AC) power supply 4 together with lighting device 1D and luminaire 5D.

As illustrated in FIG. 11, lighting device 1D includes DC power supply 17, buck converter 15D, control circuit 16B, switch unit 10B, voltage adder 18, and smoothing capacitors 141, 142, and 143. Lighting device 1D is different from lighting device 1B according to Embodiment 3 in terms of having alternating current supplied from AC power supply 4; in terms of including DC power supply 17 and voltage adder 18; and in terms of the configuration of buck converter 15D, and is identical in terms of the other structural components.

DC power supply 17 is a power supply that supplies DC voltage to buck converter 15D, and the value Vdc of the DC voltage (hereafter also simply referred to as DC voltage Vdc) is equal to the sum of the forward voltages of at least two light-emitting units from among plural light-emitting units 21, 22, and 23. It should be noted that DC voltage Vdc need only be substantially equal to the sum, and thus it is acceptable to have, between DC voltage Vdc and the sum, an error that is within the range of measurement error. In this embodiment, DC power supply 17 adjusts the DC voltage based on a signal outputted by voltage adder 18. Furthermore, DC power supply 17 is configured of, for example, an AC-to-DC converter that converts an AC voltage to DC voltage Vdc.

Buck converter 15D is a DC-to-DC converter that converts DC voltage Vdc outputted by DC power supply 17 and outputs the resulting voltage. Buck converter 15D includes smoothing capacitor 155 between input terminals, in addition to the structural components included in buck converter 15A according to Embodiment 3.

Smoothing capacitor 155 is an element for smoothing the ripple of DC voltage that is inputted to buck converter 15D.

Voltage adder 18 is a processing unit that detects the forward voltages of at least two light-emitting units from among light-emitting units 21, 22, and 23, and outputs a signal corresponding to the sum of the forward voltages of the at least two light-emitting units. In this embodiment, the potential at both ends of each of light-emitting units 21, 22, and 23 are inputted to voltage adder 18. Voltage adder 18 detects the forward voltage of each of light-emitting units 21, 22, and 23 by detecting the voltage applied to the respective one of light-emitting units 21, 22, and 23 based on the inputted potential.

[6-2. Operation]

Next, operation of lighting device 1D according to this embodiment will be described.

The timing chart for illustrating the operation of lighting device 1D according to this embodiment is the same as the timing chart of lighting device 1B according to Embodiment 3 illustrated in FIG. 6.

On the other hand, since lighting device 1D according to this embodiment has the above-described configuration, the current supplied to the respective light-emitting units is different to that in lighting device 1B according to Embodiment 3. The current supplied to the respective light-emitting units by lighting device 1D according to this embodiment is described below.

As in lighting device 1A according to Embodiment 2, in lighting device 1D according to this embodiment, average current $IL_n$ in the period in which current is supplied to each light-emitting unit 2*n* (where n is 1, 2, or 3) is represented by aforementioned Expression 6. Here, in this embodiment, since Vdc is the sum of the forward voltages of at least two of the light-emitting units, the voltage ($Vdc-VL_n$) in aforementioned Expression 6 is determined solely by the forward voltages of the light-emitting units. Accordingly, making the temperature characteristics and aging characteristics of the respective light-emitting units approximately identical would cancel out the effects of the temperature characteristics and aging characteristics of the respective light-emitting units in the average current represented by aforementioned Expression 6 and the current ratio for the respective light-emitting units. In other words, lighting device 1D according to this embodiment is capable of suppressing unevenness in the ratio of current supplied to each of the light-emitting units. Therefore, in luminaire 5D including lighting device 1D according to this embodiment, it is possible to suppress temperature dependency and aging of light color and dimming level. Stated differently, luminaire 5D including lighting device 1D is capable of realizing high color reproducibility and dimming level reproducibility.

Furthermore, in this embodiment, DC voltage Vdc outputted by DC power supply 17 is adjusted to become equal to the sum of the forward voltages of the at least two light-emitting units which is outputted from voltage adder 18. Here, since the input voltage of buck converter 15D is set to be, for example, approximately twice the forward voltage of each of the light-emitting units which are loads, DC voltage Vdc is set as the sum of the forward voltages of two of the light-emitting units. Furthermore, although DC voltage Vdc may be greater than or equal to twice the forward voltage of each light-emitting unit, caution is needed so that DC voltage Vdc does not become too big.

[6-3. Advantageous Effect, Etc.]

Because lighting device 1D according to this embodiment is configured in the manner described above, lighting device 1D also produces the same advantageous effects as lighting device 1B according to Embodiment 3.

Furthermore, lighting device 1D further includes DC power supply 17 which supplies DC voltage to buck converter 15D. Here, DC power supply 17 adjusts the DC voltage so that the DC voltage becomes equal to the sum of forward voltages of at least two of the plural light-emitting units.

Accordingly, in the case of adopting a configuration for the respective light-emitting units in which the temperature characteristics and the aging characteristics of the respective light-emitting units are approximately the same, the effects of the temperature characteristics and the aging characteristics of the respective light-emitting units are canceled out in the average current flowing to the respective light-emitting units and the current ratio for the respective light-emitting units. In other words, lighting device 1D according to this embodiment is capable of suppressing unevenness in the ratio of current supplied to each of the light-emitting units. Therefore, in luminaire 5D including lighting device 1D according to this embodiment, it is possible to suppress temperature dependency and aging of light color and dimming level. Stated differently, luminaire 5D including lighting device 1D is capable of realizing high color reproducibility and dimming level reproducibility.

Embodiment 7

Next, a lighting device and a luminaire according to Embodiment 7 will be described. The lighting device according to this embodiment has a configuration which allows further suppression of unevenness in the ratio of current supplied to each of the light-emitting units.

Hereinafter, the lighting device and the luminaire according to this embodiment will be described focusing on structural components that are different from those in lighting device 1D and luminaire 5D according to Embodiment 6, and description of common structural components will be omitted for the sake of brevity.

[7-1. Configuration]

First, a configuration of the lighting device and the luminaire according to this embodiment will be described with reference to the drawings.

Figure 12:
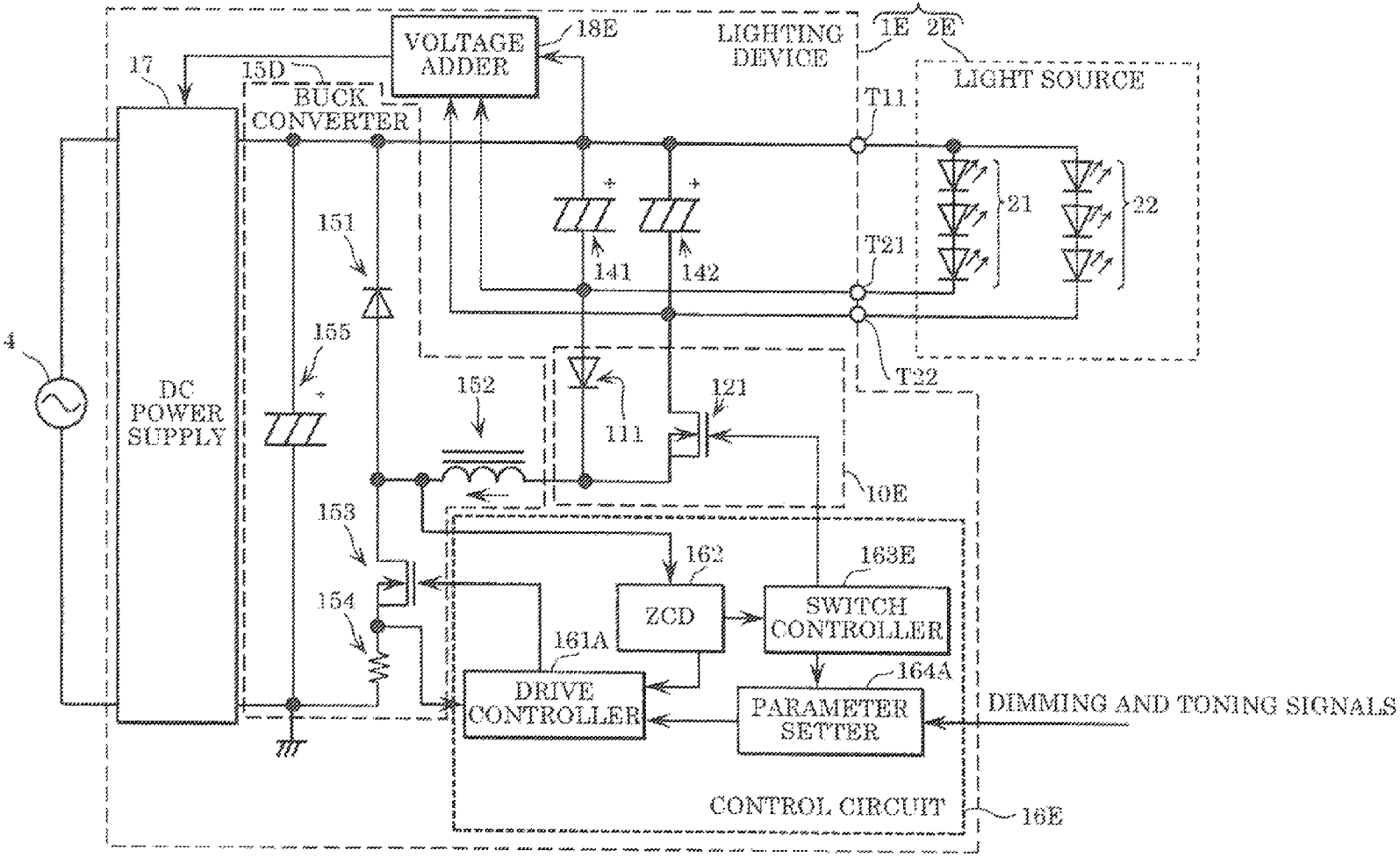
FIG. 12 is a circuit diagram illustrating a configuration of a lighting device and a luminaire including the lighting device according to Embodiment 7.

FIG. 12 is a circuit diagram illustrating the configuration of lighting device 1E and luminaire 5E including lighting device 1E according to this embodiment. FIG. 12 also illustrates AC power supply 4 together with lighting device 1E and luminaire 5E.

Luminaire 5E according to this embodiment includes lighting device 1E and light source 2E.

Light source 2E includes only the two of light-emitting units 21 and 22 each of which includes a solid-state light-emitting element.

As illustrated in FIG. 12, lighting device 1E includes DC power supply 17, buck converter 15D, control circuit 16E, switch unit 10E, voltage adder 18E, and smoothing capacitors 141 and 142. Lighting device 1E is different from lighting device 1D according to Embodiment 6 in terms of the configuration of switch controller 163 of control circuit 16E, switch unit 10E, voltage adder 18E, and smoothing capacitors 141 and 142, and is identical in terms of the other structural components.

Switch unit 10E includes second switch elements 111 and 121.

Smoothing capacitors 141 and 142 are connected in series with second switch elements 111 and 121, respectively.

Switch controller 163E selects one light-emitting unit from light-emitting units 21 and 22, each time switch controller 163E receives a zero-crossing detection signal from ZCD 162. In this embodiment, when light-emitting unit 22 is to be selected, switch controller 163E outputs a signal which causes second switch element 121 to switch to the ON state. On the other hand, when selecting light-emitting unit 21, switch controller 163E outputs a signal for causing second switch element 121 to switch to OFF. In this state, the output of current from buck converter 15D causes a forward voltage to be applied to second switch element 111, and second switch element 111 switches to the ON state.

Voltage adder 18E is a processing unit that detects the forward voltages of the two light-emitting units, i.e., light-emitting units 21 and 22, and outputs a signal corresponding to the sum of the forward voltages of the two light-emitting units.

[7-2. Operation]

Next, operation of lighting device 1E according to this embodiment will be described.

Lighting device 1E according to this embodiment does not include second switch element 131 and smoothing capacitor 143, etc., included in lighting device 1D according to Embodiment 6. With this, lighting device 1E operates to alternately cause second switch element 111 and second switch element 121 to switch to the ON state, that is, to alternately supply current to light-emitting unit 21 and light-emitting unit 22. Since the other operations are the same as those in lighting device 1D according to Embodiment 6, their description will be omitted for the sake of brevity.

Next, the current supplied to the respective light-emitting units by lighting device 1E according to this embodiment is described below. Average current $IL_1$ supplied to light-emitting unit 21 by lighting device 1E according to this embodiment can be represented by Expression 8 below by substituting "n" and "Vdc" in aforementioned Expression 6 as follows: n=1 and $Vdc=VL_1+VL_2$.

[Math. 8]

$$IL_1 = \frac{1}{2}\frac{Ip_1^2}{VL_1\cdot(Vdc-VL_1)}\Big/\left(\frac{Ip_1}{VL_1\cdot(Vdc-VL_1)}+\frac{Ip_2}{VL_2\cdot(Vdc-VL_2)}\right) = \frac{1}{2}\frac{Ip_1^2}{VL_1\cdot VL_2}\Big/\left(\frac{Ip_1}{VL_1\cdot VL_2}+\frac{Ip_2}{VL_2\cdot VL_1}\right) = \frac{1}{2}\frac{Ip_1^2}{Ip_1+Ip_2} \quad \text{(Expression 8)}$$

In the same manner, average current $IL_2$ supplied to light-emitting unit 22 by lighting device 1E can be represented by Expression 9 below.

[Math. 9]

$$IL_2 = \frac{1}{2}\frac{Ip_2^2}{Ip_1+Ip_2} \quad \text{(Expression 9)}$$

As shown in Expressions 8 and 9 above, in this embodiment, average currents $IL_1$ and $IL_2$ are amounts dependent only on threshold values $Ip_1$ and $Ip_2$. Furthermore, the currents of the respective light-emitting units are proportional to the square of the threshold values. Accordingly, in this embodiment, setting a constant threshold value allows the current to be supplied to the respective light-emitting units to be kept constant. Furthermore, the ratio of current supplied to the respective light-emitting units can be controlled to be approximately constant.

[7-3. Advantageous Effect, Etc.]

Because lighting device 1E according to this embodiment is configured in the manner described above, lighting device 1E also produces the same advantageous effects as lighting device 1D according to Embodiment 6.

Furthermore, compared to lighting device 1D according to Embodiment 6, in lighting device 1E, the plural light-emitting units comprises only two light-emitting units.

Accordingly, the output current to the respective light-emitting units is dependent solely on the threshold values. Therefore, fluctuations in output current and unevenness of output current to the respective light-emitting units can be further suppressed.

Embodiment 8

Next, a luminaire according to Embodiment 8 will be described with reference to the drawings.

Figure 13:
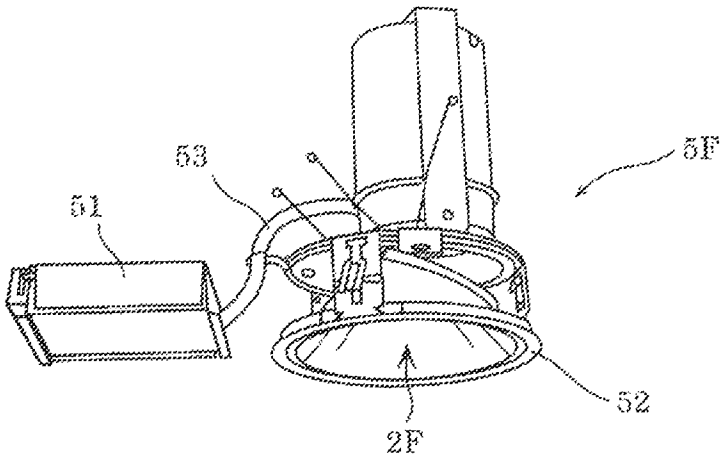
FIG. 13 is an external view of a luminaire according to Embodiment 8.

FIG. 13 is an external view of luminaire 5F according to this embodiment. Luminaire 5F includes any one of the lighting devices according to Embodiments 1 to 7, and light source 2F which receives a supply of current from the lighting device. Here, light source 2F is any one of the light sources according to Embodiments 1 to 7. In this embodiment, luminaire 5F is a downlight, and includes circuit box 51 which houses the lighting device; lamp body 52 to which light source 2F is mounted; and wire 53 which electrically connects circuit box 51 and light source 2F of lamp body 52.

Since luminaire 5F described above includes any one of the lighting devices according to Embodiments 1 to 7, luminaire 5F can produce the same advantageous effects as the lighting devices in the respective embodiments.

VARIATIONS, ETC.

Although the lighting device and luminaire according to the present disclosure have been described based on exemplary embodiments, the present disclosure is not limited to these embodiments.

For example, although plural light-emitting units 21, 22, and 23 have different light colors in the foregoing embodiments, the configuration of the light colors of the plural light-emitting units is not limited to such. In order to perform toning through the supply of current to each of the plural light-emitting units, it is sufficient that the light color of at least one of the plural light-emitting units be different from the light color of the other light-emitting units.

Furthermore, although LEDs are used as the solid-state light-emitting elements in the foregoing embodiments, other solid-state light-emitting elements such as an organic EL element may be used.

Furthermore, although a buck converter is used as the DC-to-DC converter in the foregoing embodiments, the DC-to-DC converter is not limited to a buck converter. It is sufficient that the DC-to-DC converter is a DC-to-DC converter that operates so that the current flowing in the inductor included in the DC-to-DC converter becomes zero in each switching cycle.

Furthermore, although a sequential circuit is used as a switch controller in the foregoing embodiments, the switch controller may be configured of a circuit other than a sequential circuit. The switch controller may be configured of a microcomputer, for example.

Furthermore, although ZCD 162 detects the current flowing in inductor 152 by detecting the potential at the connection point between inductor 152 and rectifier element 151 in the foregoing embodiments, the configuration for detecting the current is not limited to such. For example, a configuration may be adopted in which a secondary winding is provided to inductor 152 and the voltage generated in the secondary winding is detected.

Furthermore, although the number of light-emitting units in Embodiments 1 to 6 is three, the number of light-emitting units is not limited to three. For example the number of light-emitting units may be two, or may be four or more.

Furthermore, although the switch unit has second switch elements connected in series with the respective light-emitting units in the foregoing embodiments, a second switch element need not necessarily be connected in series with the light-emitting unit having the highest forward voltage. With this, the configuration of the switch unit can be simplified.

Forms obtained by various modifications to the respective exemplary embodiments that can be conceived by a person of skill in the art as well as forms realized by arbitrarily combining structural components and functions in the respective exemplary embodiments which are within the scope of the essence of the present disclosure are included in the present disclosure.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting device that supplies current to a plurality of light-emitting units connected in parallel and each including a solid-state light-emitting element, the lighting device comprising:

a DC-to-DC converter;

a switch unit connected to the plurality of light-emitting units;

a plurality of capacitors each connected in parallel to a different one of the plurality of light-emitting units; and a control circuit which controls the DC-to-DC converter and the switch unit, wherein the DC-to-DC converter includes:

an inductor through which current from the DC-to-DC converter is provided to the plurality of light-emitting units; and a first switch element connected in series with the inductor and which switches between an ON state and an OFF state, and the control circuit includes:

a zero-crossing detector that detects that current flowing in the inductor has become substantially zero as a result of the first switch element switching to the OFF state, and outputs a zero current detection signal;

a switch controller that selects a single light-emitting unit from among the plurality of light-emitting units and controls the switch unit to cause the current from the DC-to-DC converter to be supplied to the single light-emitting unit when the first switch element subsequently switches to the ON state, each time the switch controller receives the zero current detection signal from the zero-crossing detector;

a parameter setter that receives a signal corresponding to the single light-emitting unit selected and a signal instructing at least one of dimming and toning, and sets, for each of the plurality of light-emitting units, a parameter corresponding to the current to be supplied to the light-emitting unit; and a drive controller that controls the first switch element based on the parameter set by the parameter setter.

2. The lighting device according to claim 1, wherein the switch unit includes a plurality of second switch elements each of which is connected in series with a different one of the plurality of light-emitting units, and the switch controller is comprised of a sequential circuit that causes each of the plurality of second switch elements to switch to an ON state or an OFF state.

3. The lighting device according to claim 2, further comprising:

a rectifier element connected in reverse parallel to one of the plurality of second switch elements which is to be connected to a light-emitting unit having a lowest forward voltage among the plurality of light-emitting units.

4. The lighting device according to claim 2, wherein one of the plurality of second switch elements which is to be connected in series with a light-emitting unit having a highest forward voltage among the plurality of light-emitting units is configured as a rectifier element.

5. The lighting device according to claim 1, wherein the parameter setter sets, as the parameter, an ON time of the first switch element.

6. The lighting device according to claim 1, further comprising:

a current detector circuit that detects current flowing in the first switch element, wherein the parameter setter sets, as the parameter, a value corresponding to a threshold value of the current flowing in the first switch element, and the drive controller causes the first switch element to switch to the ON state when the drive controller receives the zero current detection signal from the zero-crossing detector, and causes the first switch element to switch to the OFF state when the current detector circuit detects that the current flowing in the first switch element has reached the threshold value.

7. The lighting device according to claim 6, further comprising a direct current (DC) power supply that supplies DC voltage to the DC-to-DC converter, wherein the DC power supply adjusts the DC voltage to make the DC voltage substantially equal to a sum of forward voltages of at least two of the plurality of light-emitting units.

8. The lighting device according to claim 7, wherein the plurality of light-emitting units includes two light-emitting units.

9. The lighting device according to claim 1, wherein, when the parameter is below a predetermined lower limit value, the switch controller avoids selecting, as the single light-emitting unit to be provided with the current from the DC-to-DC converter, one of the plurality of light-emitting units which is to be supplied with current corresponding to the parameter.

10. The lighting device according to claim 1, wherein the switch controller selects the single light-emitting unit based on a predetermined order, and the predetermined order goes around in a descending order starting from a light-emitting unit having a highest forward voltage among the plurality of light-emitting units.

11. The lighting device according to claim 1, wherein the switch controller selects the single light-emitting unit based on a predetermined order, and the predetermined order alternately repeats between (i) going around in a descending order starting from a light-emitting unit having a highest forward voltage among the plurality of light-emitting units and (ii) going around in an ascending order starting from a light-emitting unit having a lowest forward voltage among the plurality of light-emitting units.

12. The lighting device according to claim 1, wherein the switch controller selects the single light-emitting unit based on a predetermined order, and in the predetermined order, part of the plurality of light-emitting units is selected continuously for plural cycles at a time, and a remainder of the plurality of light-emitting units is selected one cycle at a time.

13. A luminaire comprising:

the lighting device according to claim 1; and the plurality of light-emitting units.

14. The luminaire according to claim 13, wherein at least one of the plurality of light-emitting units has a light color different from a light color of a remainder of the plurality of light-emitting units.

* * * * *